US011390447B2

(12) United States Patent
Zhang et al.

(10) Patent No.: US 11,390,447 B2
(45) Date of Patent: Jul. 19, 2022

(54) PACKAGING BOX WITH AIR BUFFERING PERFORMANCE AND APPLICATION THEREOF

(71) Applicant: SHANGHAI AIR-PAQ COMPOSITE MATERIAL CO., LTD., Shanghai (CN)

(72) Inventors: Jiaying Zhang, Shanghai (CN); Huazheng Yang, Shanghai (CN)

(73) Assignee: SHANGHAI AIR-PAQ COMPOSITE MATERIAL CO., LTD., Shanghai (CN)

( * ) Notice: Subject to any disclaimer, the term of this patent is extended or adjusted under 35 U.S.C. 154(b) by 1765 days.

(21) Appl. No.: 15/112,684

(22) PCT Filed: Jan. 16, 2015

(86) PCT No.: PCT/CN2015/070862

§ 371 (c)(1),
(2) Date: May 28, 2019

(87) PCT Pub. No.: WO2015/106712

PCT Pub. Date: Jul. 23, 2015

(65) Prior Publication Data

US 2021/0309435 A1 Oct. 7, 2021

(30) Foreign Application Priority Data

Jan. 19, 2014 (CN) ..... 201410022891.0
Jan. 19, 2014 (CN) ..... 201410023217.4
Jan. 19, 2014 (CN) ..... 201420031152.3
Jan. 19, 2014 (CN) ..... 201420031430.5

(51) Int. Cl.
*B65D 81/05* (2006.01)
*B65D 5/50* (2006.01)
*B65D 5/56* (2006.01)

(52) U.S. Cl.
CPC ..... *B65D 81/052* (2013.01); *B65D 5/5002* (2013.01); *B65D 5/563* (2013.01)

(58) Field of Classification Search
CPC ..... B65D 81/052; B65D 81/03; B65D 81/05; B65D 2581/051
USPC ..... 206/522
See application file for complete search history.

(56) References Cited

U.S. PATENT DOCUMENTS 4,091,852 A * 5/1978 Jordan ..... A45C 7/004 206/522
4,551,379 A * 11/1985 Kerr ..... B31D 5/0073 428/200
4,905,835 A * 3/1990 Pivert ..... B65D 81/052 206/522
5,180,060 A * 1/1993 Forti ..... B65D 81/052 206/522

(Continued)

*Primary Examiner* — Ernesto A Grano

(57) ABSTRACT

An air cushion packaging box includes at least one inflatable main body and at least one box body. The inflatable main body is provided with at least one inflating valve to inflate the inflatable main body. The inflatable main body is provided in the box body to form an integral structure with the box body, so as to provide air cushion effect to packaged items after the inflatable main body is inflated. The box body is automatically opened when the inflatable main body is inflated to enhance the use of the air cushion packaging box.

2 Claims, 28 Drawing Sheets

(56) References Cited

U.S. PATENT DOCUMENTS 5,624,035 A * 4/1997 Kim ..... B65D 81/052 206/521
5,769,232 A * 6/1998 Cash ..... B65D 81/052 206/522
6,431,361 B1 * 8/2002 Wolf ..... B65D 81/052 206/522
6,468,239 B1 * 10/2002 Mollura, Sr. ..... A61F 5/0111 128/882
8,714,356 B2 * 5/2014 Liao ..... B65D 81/052 206/522
9,617,058 B2 * 4/2017 Corvisier ..... B65D 81/052
9,623,622 B2 * 4/2017 Baines ..... B65D 81/052
2007/0051655 A1 * 3/2007 Yoshifusa ..... B65D 81/075 206/522
2007/0084745 A1 * 4/2007 Yoshifusa ..... B65D 81/052 206/522
2007/0170084 A1 * 7/2007 Chen ..... B65D 81/052 206/522
2009/0050509 A1 * 2/2009 Liao ..... B65D 81/052 206/522
2009/0242450 A1 * 10/2009 Zhang ..... B65D 81/03 206/522
2010/0072103 A1 * 3/2010 Watanabe ..... B65D 81/052 206/522
2010/0101970 A1 * 4/2010 Frayne ..... B31D 5/0073 206/522
2011/0233101 A1 * 9/2011 Baines ..... B31D 5/0073 206/522
2013/0292289 A1 * 11/2013 Zhang ..... F16K 15/202 206/522
2013/0313152 A1 * 11/2013 Liao ..... B65D 25/205 206/522
2018/0093809 A1 * 4/2018 Zhang ..... B65D 25/04
2020/0129801 A1 * 4/2020 Pace ..... A63B 21/072

* cited by examiner

B-B

PACKAGING BOX WITH AIR BUFFERING PERFORMANCE AND APPLICATION THEREOF

CROSS REFERENCE OF RELATED APPLICATION

This is a non-provisional application that claims priority to international application number PCT/CN2015/070862, international filing date Jan. 16, 2015, which claims priority to first Chinese application number 20140022891.1, filing data January 19, second Chinese application number 2014, 20140031430.5, filing data Jan. 19, 2014, third Chinese application number 201410023217.4, filing data January 19, and fourth Chinese application number 2014 20140031152.3, filing data Jan. 19, 2014, the entire contents of each of which are expressly incorporated herein by reference.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a packaging device, and more particularly to an air cushion packaging box and application method thereof.

Description of Related Arts

Referring to modern logistics industries, packaging boxes are used widely. However, packaging methods of this kind of traditional packaging boxes have never provided function of shock absorption during collision or falling. In other words, during being transported and stored, the packaging boxes are usually thrown and are deformed its shape, and further lead to the damaging or breaking of the packaged items. Therefore, for some items that need to be protected in packaging, such as digital products, plastics, ceramics, biologics, chemicals, food and medicine, a cushioning effect should be provided to prevent the packaged items from being damaged during being transported and stored.

According to traditional paper packaging boxes, existing solution is to fill cushioning foam materials into the paper packaging boxes to provide cushioning effect. However, the costs of transporting and storing are expensive during transporting the packaging boxes and the cushioning foam materials filled. On the other hand, the cushioning foam materials are not environmentally friendly and may pollute the environment.

In addition, it is possible to fill air cushioning materials into a paper packaging box. For example, after the packaged items are placed into the packaging box, an air packaging bag is inserted into the packaging box, so as to provide a cushioning effect to the packaged items. However, the air packaging bags and the packaging boxes are together sent to the designated location, such that the packaging box must be big enough to contain the item and the air packaging bags. In addition, the packaging process is complicated by initially inflating the air packaging bags and fitting the inflated air packaging bags into the packaging box to surround the item, so application thereof is not convenient.

SUMMARY OF THE PRESENT INVENTION

The invention is advantageous in that it provides an air cushion packaging box which comprises an inner layer comprising an inflatable main body and an outer layer. The outer layer is a box body. The inflatable main body and the box body are provided together, so as to effectively avoid the packaging box from being crushed to be damaged or to be out of shape during being applied. The packaging box is able to provide air cushioning effect for the packaged items.

Another advantage of the present invention is to provide an air cushion packaging box, wherein an inflatable main body and a box body are fixed together, the inflatable main body and the box body can be transported to a packaging site together. The storage thereof is convenient, so the cost of transporting and storing is saved.

Another advantage of the present invention is to provide an air cushion packaging box, wherein during being transported and being stored, it is possible to transport and to store the inflatable main body before being inflated. The box body and the inflatable main body form a compact structure, even a flatten state, so as to save space.

Another advantage of the present invention is to provide an air cushion packaging box, wherein while the packaging box is needed to be used, the inflatable main body is inflated to expand and drives the box body at the outer layer to form a packaging box shape, so as to be convenient to be used.

Another advantage of the present invention is to provide an air cushion packaging box, wherein after the inflatable main body being inflated, the step that put the inflatable main body into the box body is not needed, so as to save packaging time.

Another advantage of the present invention is to provide an air cushion packaging box, wherein while the packaging box is needed to be used, the packaged items are put into the packaging box and then the inflatable main body is inflated, thus the inflatable main body encompasses the packaged items tightly, and the box body at the outer layer will press the inflatable main body, so that the main body encompasses the packaged items more tightly, so that the packaged items can get better cushioning protection.

Another advantage of the present invention is to provide an air cushion packaging box, wherein the inflatable main body can be provided into the box body via various methods, such as pasting via glue, splicing via Velcro. The material of the box body is selected from the composition consisting of paper, cloth and cortex, so as to be used widely.

Another advantage of the present invention is to provide an air cushion packaging box, wherein the packaging box is suitable to be used in packaged items at retail or sale by bulk, so as to be suited to e-commerce sale of large batch packaged items and be suited to e-commerce sale of small batch packaged items.

Another advantage of the present invention is to provide an air cushion packaging box, wherein the inflatable main body comprises an inflatable main body being suitable to encompass packaged items, so that after the packaged items are put into the air cushion packaging box and bear the press coming from all directions. The packaging box having inflatable main body can provide cushion performance to the packaged items, so that the packaged items will not be extruded.

Another advantage of the present invention is to provide an air cushion packaging box, wherein structure of the inflatable main body makes the packaged items to be suitable to be remained into the air cushion packaging box steadily, so that it is not easy for the packaged items to be slipped off the air cushion packaging box.

Another advantage of the present invention is to provide an air cushion packaging box, wherein the air cushion packaging box is inflated via one or more non-return valves. After the inflating via the valves is finished and the air pressure in the inflatable main body reach to a predetermined air pressure, the valves close themselves, so that the application is convenient.

Another advantage of the present invention is to provide an air cushion packaging box, wherein an air inflating channel of the air cushion packaging box is sealed by two sealing films, so as to form a first sealing effect, then the air inflating channel is further sealed by a non-return sealing film, so as to form a second sealing effect, so as to avoid the air bag from leaking. In other words, if air is leaked, the air can be guided into a non-return channel formed by the non-return sealing film, so as to form air pressure supplement and further seal the air inflating channel, so as to enhance the sealing effect of the sealing film.

Additional advantages and features of the invention will become apparent from the description which follows, and may be realized by means of the instrumentalities and combinations particular point out in the appended claims.

According to the present invention, the foregoing and other objects and advantages are attained by an air cushion packaging box. The air cushion packaging box comprises at least one inflatable main body, at least one inflating valve and at least one box body. The inflating valve is provided to the inflatable main body. The inflating valve is used to inflate the inflatable main body. The inflatable main body is provided in the box body to form an integral structure with the box body, so as to provide air cushion effect to packaged items, after the inflatable main body is inflated.

Preferably, the inflatable main body is fixed to the surface of the box body.

Preferably, the inflatable main body is detachably connected to the surface of the box body.

Preferably, the inflatable main body is spliced to the surface of the box body.

Preferably, the inflatable main body is spliced to the surface of the box body by a splicing method, wherein the splicing method is selected from the combination consisting of a point splicing method, a line splicing method and an area splicing method.

Preferably, at least one part of the surface of the inflatable main body is spliced to the surface of the box body.

Preferably, the inflatable main body and the surface of the box body are connected via matching hasps.

Preferably, the material of the box body is selected from the combination consisting of cloth, cortex and paper.

Preferably, the box body is a paper box body comprising a plurality of cover wall integrally connecting with each other. The inflatable main body is spliced to at least one cover wall. After the inflatable main body is inflated, the cover walls are pushed to form a containing space.

Preferably, the structure of the paper box body is selected from the combination consisting of a single-layer paper structure being formed by a single-layer paper and a multi-layer composite paper structure being formed by a multi-layer paper.

Preferably, the multi-layer composite paper comprises two layers of, three layers of, four layers of, five layers of or more layers of composite papers.

Preferably, the multi-layer composite paper has a three layer structure comprising an inner paper, a facial paper outside and a corrugated paper inside.

Preferably, the box body comprises an inner paper, a facial paper and a interlayer between the inner paper and the facial paper.

Preferably, the inner paper and the facial paper are craft paper. The interlayer comprises more than one line of reinforcing rib extending vertically with each other.

Preferably, the interlayer has a gauze structure.

Preferably, one end of the box body is closed. The other end of the box body has an opening being used to put and to get the packaged items.

Preferably, two ends of the box body respectively have an opening being used to put and to get the packaged items.

Preferably, two ends of the box body are respectively provided with a closing structure being used to close the opening.

Preferably, the box body has a rectangle structure having six faces. Two ends of the box body respectively comprise four bottom seals. One of the four bottom seals of each end of the box body is corresponding with another one of the four bottom seals of each end of the box body, so as to seal the corresponding opening.

Preferably, the four bottom seals are suitable to be are suitable to be provided together via a method selected from the combination consisting of clipping, overlapping and bonding, so as to be used to seal the corresponding opening.

Preferably, the box body has a top opening and a bottom opening. The box body bottom end comprises four bottom seals. One of the four bottom seals of the box body bottom end is corresponding with another one of the four bottom seals of the box body bottom, so as to seal corresponding bottom opening. The box body top end comprises two foldable portions which is able to be folded along a middle folding line. Two foldable portions are provided to two opposite sides. The top end further comprises two sealing portions being provided to other two opposite sides of the box body. While being pressed, two sealing portions close to each other and are bonded together via adhesives. At the same time, two foldable portions are respectively double folded, so that two sealing portions and two foldable portions are able to seal the top opening.

Preferably, one end of the box body has a self-sealing bottom structure. While being used, the opening of one end of the box body is closed automatically. The other end of the box body is suitable to be open, so as to be used to put and get the packaged items.

Preferably, the closing structure comprises a foldable sheet pivotally extending to one side of the box body main body and a locating sheet extended to the foldable sheet. The locating sheet is suitable to be overlapped to the inner surface of the opposite side of the main body, so that the foldable sheet is used to seal the corresponding opening.

Preferably, the jointing positon of the foldable sheet and the locating sheet forms a locating slot. A locating tongue is extended to the second side of the main body. The locating tongue is suitable to be inserted into the locating slot, so as to play a locking and locating role.

Preferably, the closing structure further comprises one or more side wings being respectively extended to the foldable sheet, so that while sealing, the side wings attach to the inner surface of the main body.

Preferably, the plurality of cover wall of the box body comprises a plurality of top cover wall. The top cover wall closes the top of the box body in a manner selected from the combination consisting of overlapping by part, overlapping in whole and snapping with each other.

Preferably, the plurality of cover wall of the box body comprises a plurality of bottom cover wall. The bottom cover wall closes the bottom of the box body in a manner selected from the combination consisting of overlapping by part, overlapping in whole and snapping with each other.

Preferably, the plurality of cover wall comprises two side cover walls being arranged oppositely and two foldable walls respectively connecting with the two side cover walls. The two foldable walls are suitable to be folded. After the inflatable main body is inflated, the two foldable walls are suitable to be pushed to open.

Preferably, the top end and/or the bottom end of the two side cover walls are able to be bonded together.

Preferably, the air cushion packaging box further comprises one or more sealing portions bonded to the top end and/or the bottom end of the two side cover walls, so as to close the foldable walls are suitable to be folded.

Preferably, the inflatable main body comprises one or more inflatable cells. Each of the inflatable cell forms an inflatable cavity. Each of the inflatable cells is provided with one or more inflating valves.

Preferably, the inflatable main body comprises one or more lists of discontinuously provided dividing seams, so that one inflatable cell is divided to form one or more sub-inflatable cells, so as to form a plurality of side walls of the inflatable main body.

Preferably, the inflatable main body is suitable to surround the packaged items.

Preferably, the inflatable main body forms an inner bag layer after being inflated.

Preferably, the inner bag layer formed by the inflatable main body comprises four surrounding walls formed by the sub-inflatable cells.

Preferably, the inner bag layer formed by the inflatable main body further comprises a bottom wall formed by the sub-inflatable cells, so as to form structure of one end closing the opening at the other end.

Preferably, the inner bag layer formed by the inflatable main body further comprises a movable top wall formed by the sub-inflatable cell. The movable top wall is used to seal the opening defined by the inner bag layer and being used to put and get the packaged items.

Preferably, a connecting seal is provided between two neighboring inflatable cells, wherein each of the inflatable cells forms a discrete cell, so that the damaging of one of the inflatable cell will not affect other inflatable cells.

Preferably, the outer surfaces of one or more sub-inflatable cells are spliced to the surface of the box body.

Preferably, the outer of the inflatable cells is spliced to the surface of the box body.

Preferably, the packaging box comprises one or more inflatable main bodies and a plurality of end to end inflatable main bodies.

Preferably, while forming the inner bag of the packaging box, the inflatable main body is provided with foldable units at two opposite side near the opening, so as to make for being folded, so as to close the corresponding opening.

Preferably, each of the foldable units comprises a plurality of sub-inflatable cells. Each of the sub-inflatable cells is provided with a plurality of interval arranged sealing seams. The width of the sealing seam is smaller than the width of the sub-inflatable cell.

Preferably, each of the foldable units comprises a plurality of sub-inflatable cells. The sub-inflatable cells are un-inflatable for being sealed, so as to form un-inflated foldable units.

Preferably, the inflatable cells comprise a set of major diameter inflatable cells and a set of minor diameter inflatable cells, wherein a diameter size of the major diameter inflatable cell is larger than a diameter size of the minor diameter inflatable cell. The major diameter inflatable cells and the minor diameter inflatable cells are stagger in an alternating manner.

Preferably, two or more the inflating valves are provided to one major diameter inflatable cell. One of the inflating valves is provided to one minor diameter inflatable cell.

Preferably, one of two neighboring sub-inflatable cells near to the opening of the inner bag layer formed by the inflatable main body is provided with a plurality of interval dividing seams, whereby after inflating, one end of one of the neighboring sub-inflatable cells is pressed to one end of the other neighboring sub-inflatable cells, so as to play a function of tightening opening.

Preferably, parts of the inflatable main body form the un-inflatable cells via heat sealing the inflating valves.

Preferably, the packaging box comprises two or more inflatable main bodies. One of the inflatable main bodies is connected to the surface the other inflatable main body. The position of the connecting seal of one inflatable main body faces to the inflatable cell of the other the inflatable main body, so that the inflatable cell of two or more the inflatable main body are stagger arranged.

Preferably, the inflatable main body has a first chamber layer and a second chamber layer. The inflating valve is a single direction non-return valve being provided between the first chamber layer and the second chamber layer. While the inflatable cavity is fully filled with air, the sing direction non-return valve closes itself, so as to avoid air from being leaked.

Preferably, the inflating valve comprises two valve films being respectively heat sealed together with the first chamber layer and the second chamber of the inflatable cell of the inflatable main body. An air inflating channel in formed between two valve films. After air is inflated into the inflatable cells through the air inflating channel, the inner surfaces of two valve films are bonded together automatically, so as to avoid the gas entered into the inflatable cell from being leaked through the air inflating channel.

Preferably, the inflating valve is a double non-return valve. The inflating valve comprises:

a first sealing film and a second sealing film. The first sealing film and the second sealing film are overlapped between the first chamber layer and the second chamber layer of the inflating cell. The first sealing film and the second sealing film are extended into the inflatable cavity through the opening of the valve of the inflating cell; and a non-return sealing film being overlapped to a first end of the first sealing film and a first end of the second sealing film, so as to form an air inflating channel between the first sealing film and the non-return sealing film, and form a non-return channel between the non-return sealing film and the second sealing film. The air inflating channel is arranged to be used to inflate air into the inflatable cavity, so as to fill the inflatable cell until the pressure in the inflatable cavity makes the a second end of the first sealing film and a second end of the second sealing film overlapping and sealing to close the air inflating channel. If air is leaked between the second end of the first sealing film and the second end of the second sealing film, air in the inflatable cavity is guided into the non-return channel, so as to provide a pressure supplement, and further seal the air inflating channel, so as to enhance the sealing effect of the first sealing film and the second sealing film.

Preferably, the non-return channel has an opening end facing to the inflatable cavity and a closed end facing to the opening of the air valve, so that while air is inflated into the non-return channel through the opening end, the non-return channel is inflated with air, so as to provide a pressure supplement, so as to further seal the air inflating channel, so as to enhance the sealing effect of the first sealing film and the second sealing film.

Preferably, the inflating valve further comprises a first seal joint portion bonding the first chamber layer and the first sealing film together at the opening of the valve of the inflatable cell and a second seal joint portion bonding the second chamber layer, the non-return sealing film and the second sealing film seal the air inflating channel, so as to enhance the sealing effect of the first sealing film and the second sealing film.

Preferably, the length of the non-return sealing film is smaller than the length of each of the first sealing films and each of the second sealing films, so that the non-return sealing film overlaps to a first end of the first sealing film and a first end of the second sealing film. A second end of the first sealing film and a second end of the second sealing film are overlapped together.

In accordance with another aspect of the invention, the present invention comprises a method of packaging packaged items via a packaging box. The packaging box comprises at least one inflatable cell and at least one box body. The method comprises the following steps:

inflate to the inflatable cell via at least one inflating valve; and push the box body, while the inflatable cell being inflated to expand, so that the box body is pushed to the surrounds of the inflatable cell, so that the packaging box is used to contain the packaged items. The inflatable cell is provided to the surface of the box body.

Preferably, the packaged items are put into the packaging box after the inflatable cell is inflated.

Preferably, the packaged items are put into the packaging box before the inflatable cell is inflated. After the inflated cell is inflated, the inflatable cell extends between the packaged items and the box body.

Preferably, the inflatable cell is connected to the surface of the box body.

Preferably, at least a part of the outer surface of the inflatable cell is spliced to the surface of the box body.

Preferably, a point splicing, a line splicing or an area splicing is formed between the inflatable cell and the box body.

Preferably, the box body is a paper box body. The paper box body comprises a single layer paper or a multi-layer composite layer.

Preferably, one end of the box body is closed. The other end of the box body has an opening being used to put and get the packaged items.

Preferably, two ends of the box body respectively have openings, so as to be suitable to put and get the packaged items.

Preferably, the method further comprises the following step: sealing one or more openings of the box body via the closing structure of the box body.

Preferably, the inflatable main body comprises one or more inflatable cells.

Each of the inflatable cells forms an inflatable cavity. Each of the inflatable cells is provided with one or more inflating valves.

Preferably, the inflatable main body comprises one or more lists of discontinuously provided dividing seams, so that the inflatable cell is divided to form one or more sub-inflatable cells, so as to form a plurality of side walls of the inflatable main body.

Preferably, the inflatable main body has a first chamber layer and a second chamber layer. The inflating valve is a single direction non-return valve. The inflating valve is provided between the first chamber layer and the second chamber layer. After the inflatable cavity is fully filled with air, the single direction non-return valve closes itself automatically, so as to avoid air from being leaked.

Preferably, the inflating valve comprises two valve films respectively heat sealed together with the first chamber layer and the second chamber layer of the inflatable cell of the inflatable main body. An air inflating channel is formed between the two valve films. After the inflatable cell is inflated with air, the inner surfaces of two valve films are bonded together automatically, so as to avoid the gas entered into the inflatable cell from being leaked through the air inflating channel.

Preferably, the inflating valve is a self-adhesive film non-return valve. The valve is a double non-return valve. Inflating valve comprises a first sealing film, a second sealing film and a non-return sealing film. The first sealing film and the second sealing film are overlapped between the first chamber layer and the second chamber layer of the inflating cell. The first sealing film and the second sealing film are extended into the inflatable cavity through the opening of the valve of the inflating cell; and The non-return sealing film is overlapped to a first end of the first sealing film and a first end of the second sealing film, so as to form an air inflating channel between the first sealing film and the non-return sealing film, and form a non-return channel between the non-return sealing film and the second sealing film. The air inflating channel is arranged to be used to inflate air into the inflatable cavity, so as to fill the inflatable cell until the pressure in the inflatable cavity makes the a second end of the first sealing film and a second end of the second sealing film overlapping and sealing to close the air inflating channel. If air is leaked between the second end of the first sealing film and the second end of the second sealing film, air in the inflatable cavity is guided into the non-return channel, so as to provide a pressure supplement, and further seal the air inflating channel, so as to enhance the sealing effect of the first sealing film and the second sealing film.

Preferably, the box body comprises two layers of craft papers and a gauze layer in the middle.

Preferably, the box body comprises an inner paper, a facial paper and a corrugated paper being provided between the inner paper and the facial paper.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
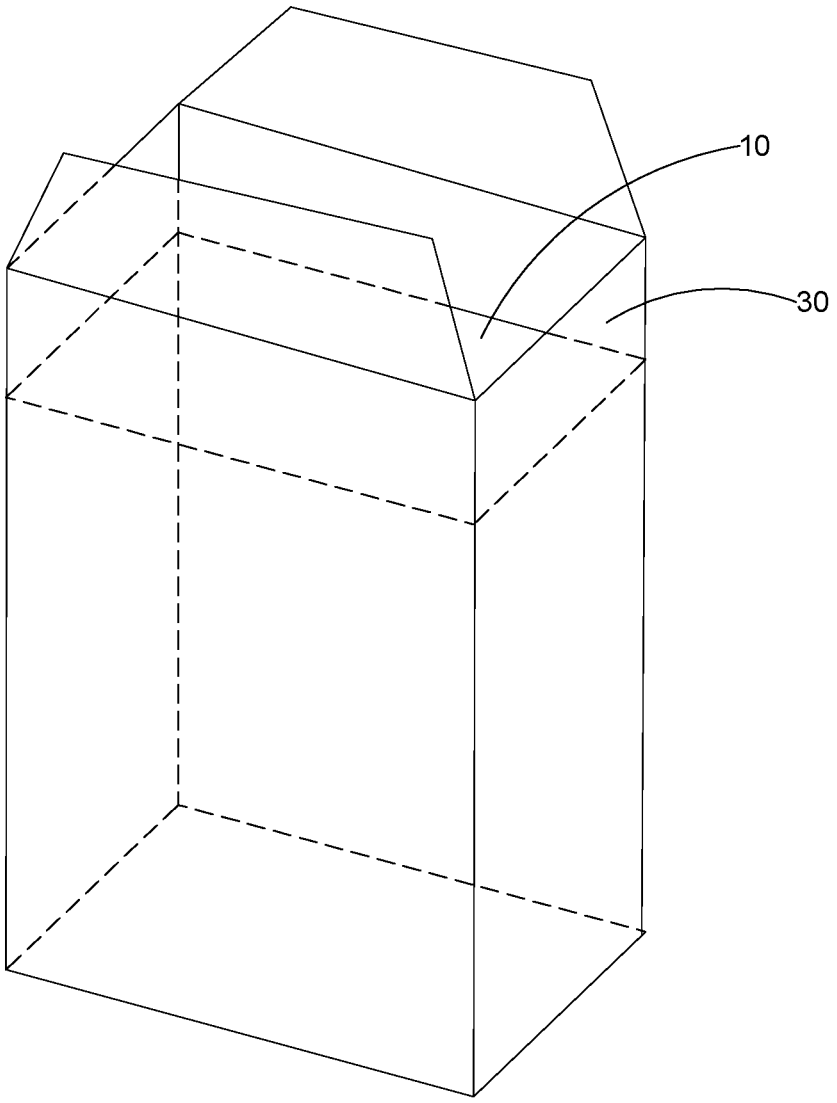
FIG. 1 is a perspective view of an air cushion packaging box according to a first preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

FIGS. 1 to 5 illustrate an air cushion packaging box according to a preferred embodiment of the present invention. The packaging box can be used to store packaged items, such as electronic products, food, medicine products, chemical materials, biological materials, plastics, ceramics, and Fast Moving Consumer Goods. Due to the packaging box has cushion performance, so as to be suitable to be used to provide air cushion performance for the packaged items.

In detail, the packaging box comprises at least one inflatable main body 10 and a box body 30. The inflatable main body 10 is provided with at least one inflating valve 20. The inflatable main body 10 is provided to the inner surface of the box body 30, so as to form an integrated structure. The inflating valve 20 is used to inflate air into the inflatable main body 10. The inflatable main body 10 is used to provide air cushion performance to the packaged items.

In other words, the inflatable main body 10 forms the inner structure of the packaging box. The box body 30 forms the outer structure of the packaging box. After the inflatable main body 10 is inflated, the box body 30 encompasses to the outer side of the inflatable main body 10, so as to contain the inflatable main body 10.

Thus, the packaging box makes the inflatable main body 10 and the box body 30 being transported to the packaging place together, so as to be used to package the packaged items. The inflatable main body 10 without being inflated can be transported and stored, so that the inflatable main body 10 can present a flat shape like being condensed, so as to save space being occupied during transporting and storing. While being used, it is needed only to inflate the inflatable main body 10 via the inflating valve 20 to reach a predetermined air pressure, the expansion of the inflatable main body 10 drives the box body 30 to shape up. Thus, relative to the conventional packaging technique, the step of inserting inflatable cushion into a packaging carton or a packaging box is not needed, so as to save packaging time greatly.

It is worth mentioning that while being packaging, it is also possible to put the packaged items into the packaging box, and then inflate into the inflatable main body 10. Then the inflatable main body 10 expands and encompass around the packaged items. And while expansion, the inflatable main body 10 adjusts position automatically, so that the inflatable main body 10 encompasses around the packaged items tightly, so that after the inflating is finished, the packaged items can be steadily remained into the box body 30 via the inflatable main body 10. In addition, while inflating air into the inflatable main body 10, the box body 30 presses the inflatable main body 10 at the same time, so that the pressure can make the inflatable main body 10 being contained into the inflatable main body 10 more tightly, so as to form a compact structure.

The inflatable main body 10 can be provided to the inner surface of the box body 30 by various methods, such as splicing via glue or other adhesives. The glue between the inflatable main body 10 and the box body 30 can be spliced along splicing lines, at some partial points or at the whole region. One skilled in the art will understand that other providing methods can also reach such effect, for example, corresponding hasp elements, such as Velcro, are respectively provided to the inner surface of the inflatable main body 10 and the inner surface of the box body 30.

Preferably, according to the preferred embodiment of the present invention, the inflatable main body 10 and the box body 30 are coupled together via glue. The viscous force between the inflatable main body 10 and the box body 30 is strong enough, so that while inflating into the inflatable main body 10, the inflatable main body 10 will not be peel off the box body 30. In other words, the viscous force between the inflatable main body 10 and the box body 30 is greater than the pulling force between the inflatable main body 10 and the box body 30, while the inflatable main body 10 is inflated.

The box body 30 can be made of various conventional materials, such as leather materials, cloth materials and paper materials. For example, according to the preferred embodiment of the present invention, the box body 30 can be paper carton, wherein the shape thereof can be rectangle, square, multilateral, alien box, cylindrical, etc. It can be a single layer, and also can be two layers, three, four, five layer or more layers of composite structure. For example, the box body 30 comprises an inner paper inside, a core paper in the middle and a facial paper outside. The inner paper and the facial paper can be tea paperboard, craft paper, etc. The core paper can be corrugated paper, etc., wherein more than one layer of corrugated paper can be provided, so as to bear the collision and dropping during being carrying. The box body 30 not only can be made of hard paper materials, but also be made of soft paper materials. There is no limitation in this aspect of the present invention.

Figure 2:
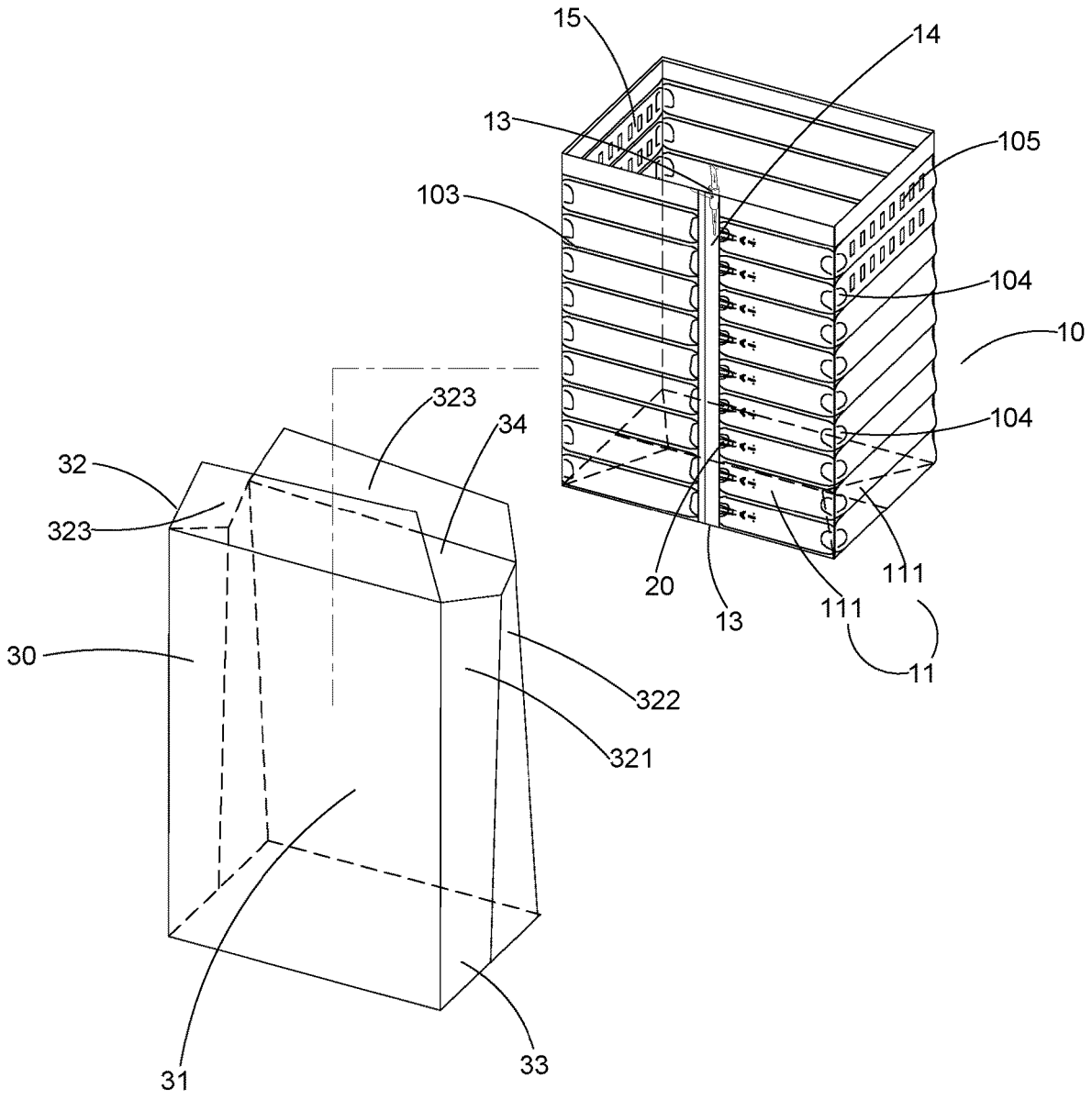
FIG. 2 is an exploded perspective view of the air cushion packaging box according to the above first preferred embodiment of the present invention.
Figure 5:
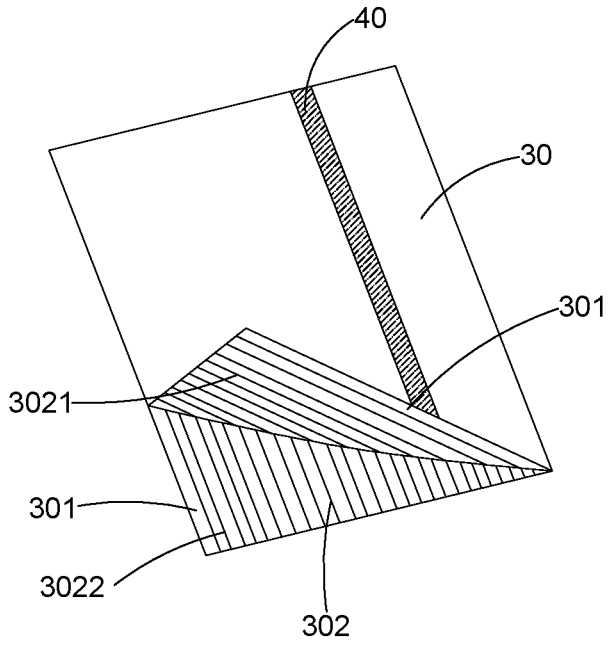
FIG. 5 is a schematic view of a box body of the air cushion packaging box according to the above first preferred embodiment of the present invention.

As shown in FIG. 2 and FIG. 5, according to the preferred embodiment of the present invention, the box body 30 can be three layers structure, which comprises two layers of craft paper 301 as the inner paper and a reinforcing rib interlayer 302 in the middle. The material of craft paper 301 is light and soft, the middle reinforcing rib interlayer 302 can be kept between the two layers of craft paper 301, so as to avoid the box body 30 from being damaged. Preferably, the reinforcing rib interlayer 32 can comprise more than one line of mutually perpendicular reinforcing rib, for example more than one line of horizontal reinforcing rib 3021 and more than one line of lengthways reinforcing rib 3022. More than one line of the horizontal reinforcing rib 3021 can form more than one set of horizontal reinforcing ribs. A predetermined distance is provided between two neighboring horizontal reinforcing ribs. The horizontal reinforcing ribs can be attached to the outer layer of craft paper 301 of the two layers of craft paper 301.

Analogously, more than one line of the lengthways reinforcing rib 3022 can form more than one set of lengthways reinforcing rib. A predetermined distance is provided between two neighboring sets of lengthways reinforcing ribs. More than one set of lengthways reinforcing ribs are attached to the inner layer of craft paper 301 of the two layers of craft paper 301. According to this preferred embodiment of the present invention, the reinforcing rib interlayer 302 can have a gauze structure. The reinforcing rib interlayer 302 can comprise more than one line of mutually perpendicular yarns.

The box body 30 can have a rectangle structure having six faces. The box body 30 has a main body 31. The main body 31 has four side faces. A pasting edge 311 of one of the side faces is bonded to the surface of another side face, so as to form a hollow structure. The box body 30 further comprises two ends 32 and 33, such as a top end 32 and a bottom end 33, so that the box body 30 forms a rectangle containing space 34 while packaging the packaged items. The two ends 32 and 33 respectively comprise four bottom seals. Two of the four bottom seals correspond with the other two of the four bottom seals, so as to be clipped together. According to this preferred embodiment of the present invention, the bottom end 33 comprises four bottom seals 331. Two of the four bottom seals 331 correspond with the other two of the four bottom seals 331, and the four bottom seals 331 extend to the main body 31, so as to be clipped together, so that while the box body 30 is used to package the packaged items, the bottom opening can be sealed. It is worth mentioning that according to the preferred embodiment of the present invention, four bottom seal 331 can be bonded together via adhesives. The top end 32 forms a top opening 34, which is used to pick-and-place the packaged items. Of course, the packaged items can also be picked and placed through the bottom opening. The top end 32 comprises two foldable portions 321. Each foldable portion can be folded along a folding line 322 in the middle. The two foldable portions 321 are provided to two reverse sides, such as a left side and a right side. The top end 32 further comprises two sealing portions 323 being provided other reverse two sides of the box body 30, such as a front side and a rear side. While the two sealing portions 323 are pressed, the two sealing portions 323 approach each other and can be bonded together via adhesives. At the same time, the two foldable portions 321 are respectively folded, so that the two sealing portions 323 and the two foldable portions 321 can seal the top opening 34. It is worth mentioning that the two sealing portions 323 and the two foldable portions 321 can integrally extend to the main body 31.

In an unused state, the inflatable main body 10 is not inflated with air, i.e. deflated state, the main body 31 of the box body 30 stay at a packed state, wherein the front side surface and the rear side surface can approach each other, so that the volume of the whole packaging box is small. The packaging box presents a flat shape to be suitable to be stored and transported. While inflating the inflatable main body 10, the expansion of the inflatable main body 10 drives the box body 30 to form its shape. Then, one of more packaged items are put into the packaging box 30. Alternatively, the packaged items are put into the packaging box before the inflating is applied. Then, according to the requirement, the opening of two ends of the box body 30 is sealed, so that the whole packaging process is finished. It is worth mentioning that the box body 30 can have a structure which can seal the bottom automatically. In other words, after the inflating is finished, at least one end selected from the top end and the bottom end can seal the opening automatically. In addition, according to the requirement of some occasion, the bottom end 33 of the box body 30 can be sealed before being inflated. In other words, the box body 30 can be configured to not having the bottom opening and to only have the top opening 34.

It is worth mentioning that, in general, the box body 30 has a regular geometrical shape, which is provided around the inflatable main body 10. During being transported and being stored, more than one packaging box is arranged fitly. In other words, if only the inflatable main body 10 is used to package the packaged items, after the inflatable main body 10 is inflated, a regular shape is not necessarily formed, so it is not convenience to be fitly arranged and placed during being transported. In addition, the box body 30 not only has the function of protecting the inflatable main body 10 from being crashed by hard articles to be damaged. In addition, the box body 30 can make the packaging more beautiful. Logo, art pattern and text ads can be provided to the outside surface of the box body 30.

In other words, the packaging box according to the present invention assembles the inflatable main body 10 and the box body 30 together. The structure makes the packaging process more timesaving and convenient. The inflatable main body 10 forms its shape automatically while inflating. The inflatable main body 10 and the box body 30 are transported and stored as a whole, so that the cost is low. In addition, the inflatable main body 10 provides an air cushion performance. The box body 30 has an advantage of protecting the inflatable main body 10 and an advantage of pressing the inflatable main body 10 and holding the inflatable main body 10 to the packaged items steadily. The box body 30 also has an advantage of enhancing aesthetic effect of the packaging box. The above advantages cannot be realized while packaging only by the inflatable main body 10 or only by the box body 30.

The inflatable main body 10 can be bonded to at least one part of the surface of the box body 30, such as the surface of some side face. The inflatable main body 10 can also be bonded around the surface of the box body 30, so that after the inflating is finished, the inflatable main body 10 forms a containing space thereof, which is used to contain the packaged items.

In detail, as shown in FIGS. 2-4 and FIGS. 7-11B, the inflatable main body 10 comprises at least one inflatable cell 11, wherein the inflatable cell 11 comprises a first chamber layer 101 and a second chamber layer 102. The first chamber layer 101 and the second chamber layer 102 overlap with each other to form an inflatable cavity 12 and to form at least one air inflating opening 13. The air inflating opening 13 communicates with the inflatable cavity 12, so as to be used to inflate air into the inflatable cavity 12. As shown in the drawings, two or more inflatable cells 11 are arranged side by side, so as to form the inflatable main body 10, wherein the inflating valve 20 is provided to each inflatable cell 11. In other words, each inflatable cell 11 can be inflated independently. An extending connecting seal 103 is formed between two neighboring inflatable cells 11, wherein each of the inflatable cells 11 forms a discrete cell, so that the inflatable cavity 12 is divided into a plurality of individual inflatable cavities 12 via the connecting seal 103. The connecting seal 103 can be formed by a heat sealing technology. Thus, when one of the inflatable cells 11 is damaged to leak, other inflatable cells 11 will not be affected. Of course, it is worth mentioning that the inflatable cells 11 can also communicate with each other. Thus only one inflating valve 20 is needed to inflate to all of the inflatable cells 11. In other words, the air cushion packaging box according to the present invention can forms a plurality of inflatable cell 11 via the heat sealing of the first chamber layer 101 and the second chamber layer 102.

In addition, due to the shape of each inflatable cell 11 can be changed after being inflated, the inflatable main body 10 can be made to form various of shapes and sizes. The inflatable cell 11 can be strip (such as horizontal strip and/or lengthways strip et al.), lump et al. The shape thereof is not limited. According to the preferred embodiment of the present invention, the shape of the inflatable cell 11 can be strip. According to the preferred embodiment of the present invention, the inflatable main body 10 can also form an inflating channel 14. The inflating channel 14 communicates with the air inflating opening 13 and communicates with each inflatable cell 11 via one or more of the inflating valves 20. Thus, while inflating air through the air inflating opening 13, air will enter into the inflating channel 14, then the inflating channel 14 guides air into each of the inflating valves 20, and then air enters into each of the inflatable cells 11. In other words, the inflating channel 14 is an air distributing channel, which distributes the air being inflated from the air inflating opening 13 to each of the inflatable cells 11. An inflating mouth can be provided to the air inflating opening 13, so as to connect an inflating device, such as an air pump, so as to fill air into the air cushion packaging box.

Each of the inflatable cells 11 of the inflatable main body 10 respectively has a plurality of dividing seam 104. Thus, each of the inflatable cells 11 further forms a plurality of corresponding sub-inflatable cell 111. It is worth mentioning that the position of dividing seams 104 of the inflatable cell 11 are corresponding. In other words, the inflatable main body 10 has more than one list of dividing seams 104. The dividing seams 104 being provided to the inflatable cells 11 are linear arranged but not continuously. The inflatable main body 10 can be folded along the dividing seam 104, wherein a side wall is formed between two neighboring lists of the dividing seams 104, so that the air cushion packaging box forms a plurality of side walls. It is worth mentioning that the dividing seams 104 of the inflatable main body 10 are aligned with the folding edge of the box body. This side walls surround a containing cavity 100, which is used to contain the packaged items.

Figure 3A:
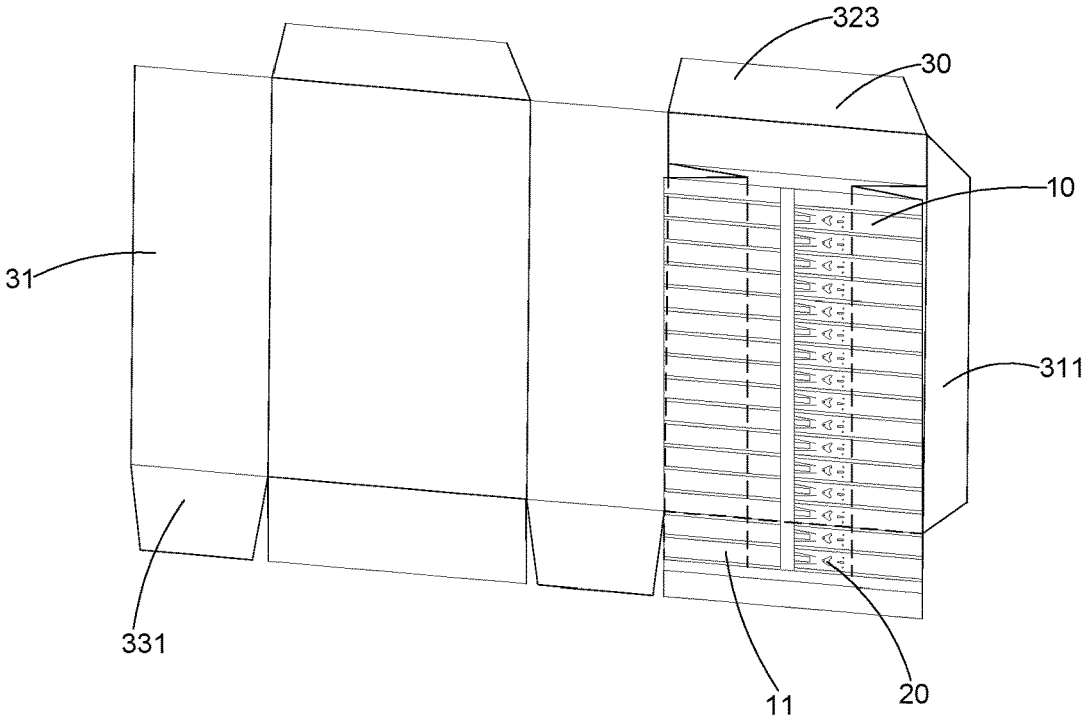
FIG. 3A is a schematic view of the air cushion packaging box according to the above first preferred embodiment of the present invention before the fluid container being inflated.
Figure 3B:
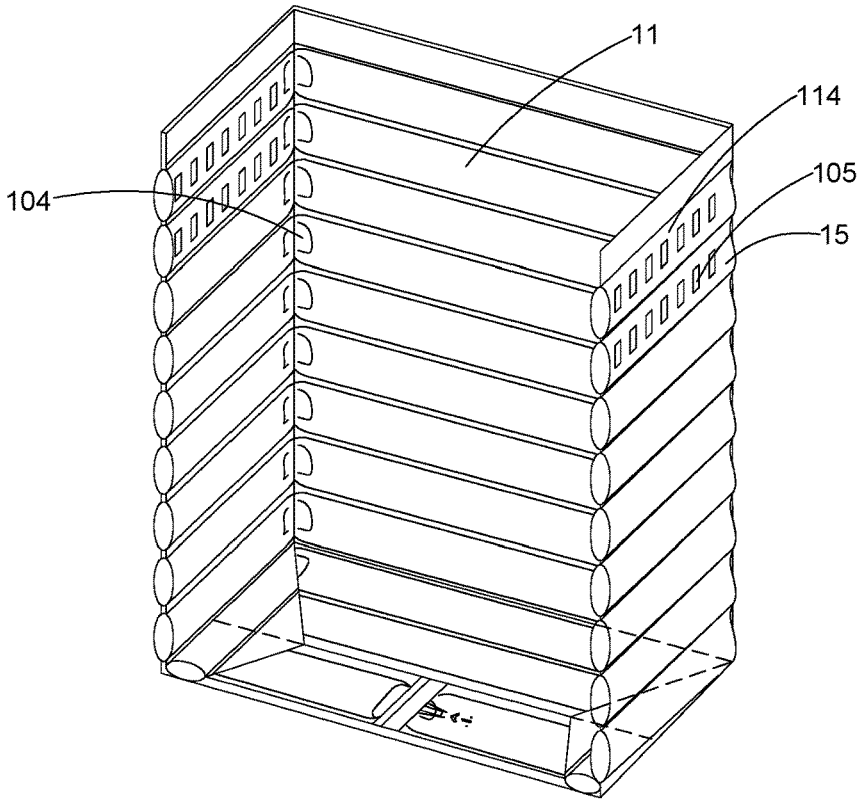
FIG. 3B is a sectional view of the air cushion packaging box according to the above first preferred embodiment of the present invention after the fluid container is inflated.
Figure 4:
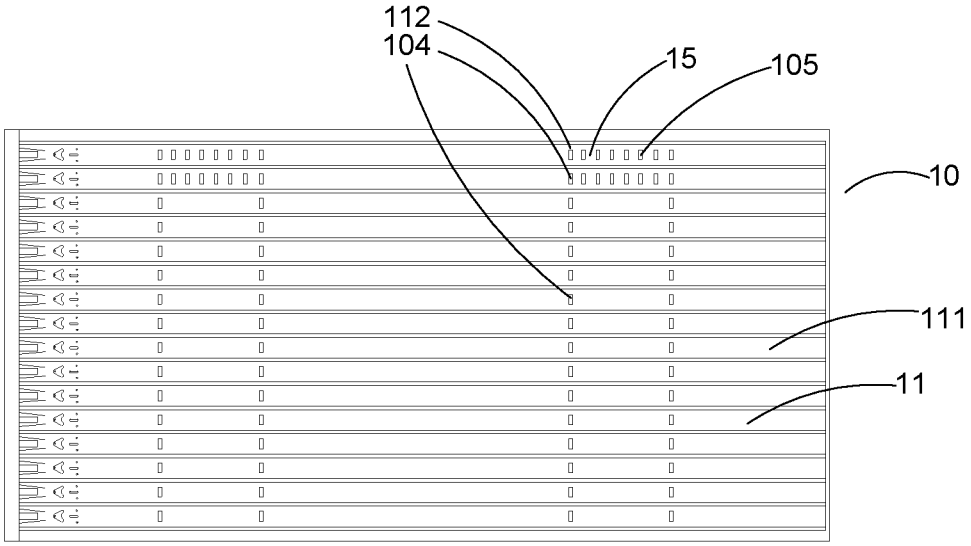
FIG. 4 is a schematic view of an unfolding structure of an inflatable main body of the air cushion packaging box according to the above first preferred embodiment of the present invention before the fluid container being inflated.

The number of the dividing seams 104 of each of the inflatable cells 11 can be provided as requirement. In other words, the number of the list of the dividing seam 104 of the inflatable main body 10 can change, so that the corresponding inflatable main body 10 can have three, four or more side walls. As shown in FIG. 2 and FIG. 3, the air cushion packaging box can form a bottom wall, four surrounding walls and a top wall. It is worth mentioning that these dividing seams 104 can be formed by the heat sealing technology. According to the number of the side walls being formed, the containing cavity can form various containing spaces.

In addition, these dividing seams 104 have not divided neighboring sub-inflatable cells 111. In other words, at least one communicating channel 112 is formed between neighboring sub-inflatable cells 111, so that while inflating, air enters into each of the sub-inflatable cells 111 through these communicating channels 112. According to the embodiment shown in the drawing, the dividing seam 104 is formed to the center position between neighboring sub-inflatable cells 111 by heat sealing. The two sides of the dividing seam 104 form the communicating channels 112.

According to the preferred embodiment of the present invention, the air cushion packaging box can comprise one inflatable main body 10, which forms an air packaging device having the containing cavity via a series of heat sealing technologies. According to other embodiments, the air cushion packaging box can be form by two inflatable main bodies 10, three or more inflatable main bodies 10. The head and the tail of the inflatable main bodies 10 are sealed together, so as to form the packaging device having the containing cavity. According to the present invention, there is no limitation in this aspect.

According to the preferred embodiment of the present invention, the inflatable main body 10 forms an end sealing. The other end of the inflatable main body 10 has an opening. In other words, the inflatable main body 10 has four surrounding walls and a bottom wall formed by the inflatable cell 11. At the positon of the top opening of the inflatable main body 10, the sub-inflatable cells 111 of the two reverse side walls, such as a left side wall and a right wall can be respectively provided with one or more sealing seam 105. The sealing seams 105 can be arranged with gaps between. The sealing seams 105 can be arranged paralleling with corresponding dividing seams 104. The size of each of the sealing seams 105 can be less than the size of corresponding inflatable cells 11, so that an inflating way 114 is formed to part of corresponding sub-inflatable cells 111, so that air can be inflated, so that the left side and the right side thereof respectively have a foldable unit 15. It is worth mentioning that the function of the connecting seal 103, the dividing seam 104, the sealing seam 105 or other heat sealing seams according to the present invention is to connect two or more layers of thin films by the heat sealing technology.

In other words, with respect to the front side and the rear side of the top opening of the air packaging bag, the inflatable cells 11 at the left side and the right side are only inflated partially, so that the inflatable cells 11 at the left side and the right side can be folded, so that inflatable cells 11 at the front side and the rear side can approach with each other, so that the top opening of the air packaging bag formed by the inflatable main body 10 can be closed.

Each of the sub-inflatable cells 111 formed by the inflatable cells 11 can be arranged into the box body 30 along the horizontal direction or the lengthways direction. The outer walls of one or more sub-inflatable cells 111 are bonded to the inner surface of the box body 30 via adhesives 40. For example, the front side and the rear side of the air packaging bag formed by the inflatable main body 10 or at least one side of the sub-inflatable cells 111 is bonded to the inner surface of the box body 30. Alternatively, the left side and the right side of the sub-inflatable cells 111 are bonded the inner surface of the box body 30. Alternatively, the sealing position of the head and the tail of the inflatable main body 10 are bonded the inner surface of the box body 30 via the adhesives 40.

With regard to the box body 30, if the box body 30 has a roughly rectangle shape, the inner surface of at least one of the four surrounding walls is bonded to the outer surface of the inflatable main body 10. For example, the connection of the box body 30 and the inflatable main body 10 can be point splicing, line splicing, or area splicing. The box body 30 and the inflatable main body 10 can also be bonded by connecting some un-inflated outer side of the inflatable main body 10 and the inner surface of the box body 30. In other words, the connecting position is not limited. The box body 30 and the inflatable main body 10 can be connected together via various methods.

Figure 6A:
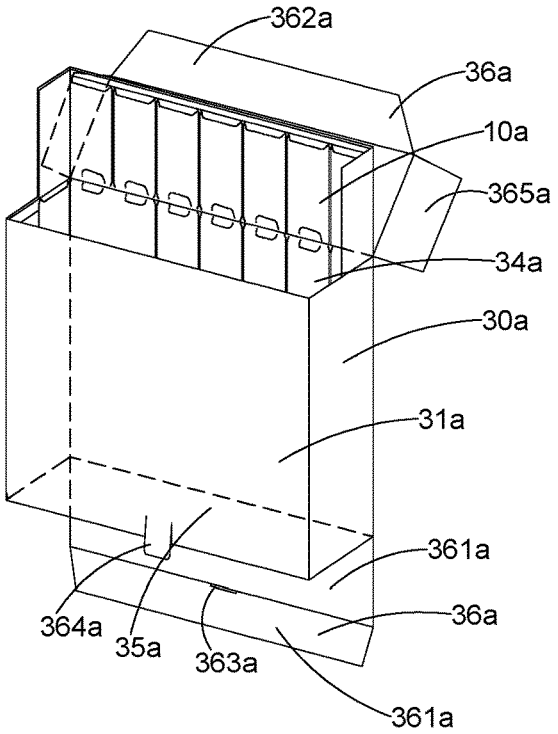
FIG. 6A is a perspective view of an alternative mode of the inflatable main body of the air cushion packaging box according to the above first preferred embodiment of the present invention.
Figure 6B:
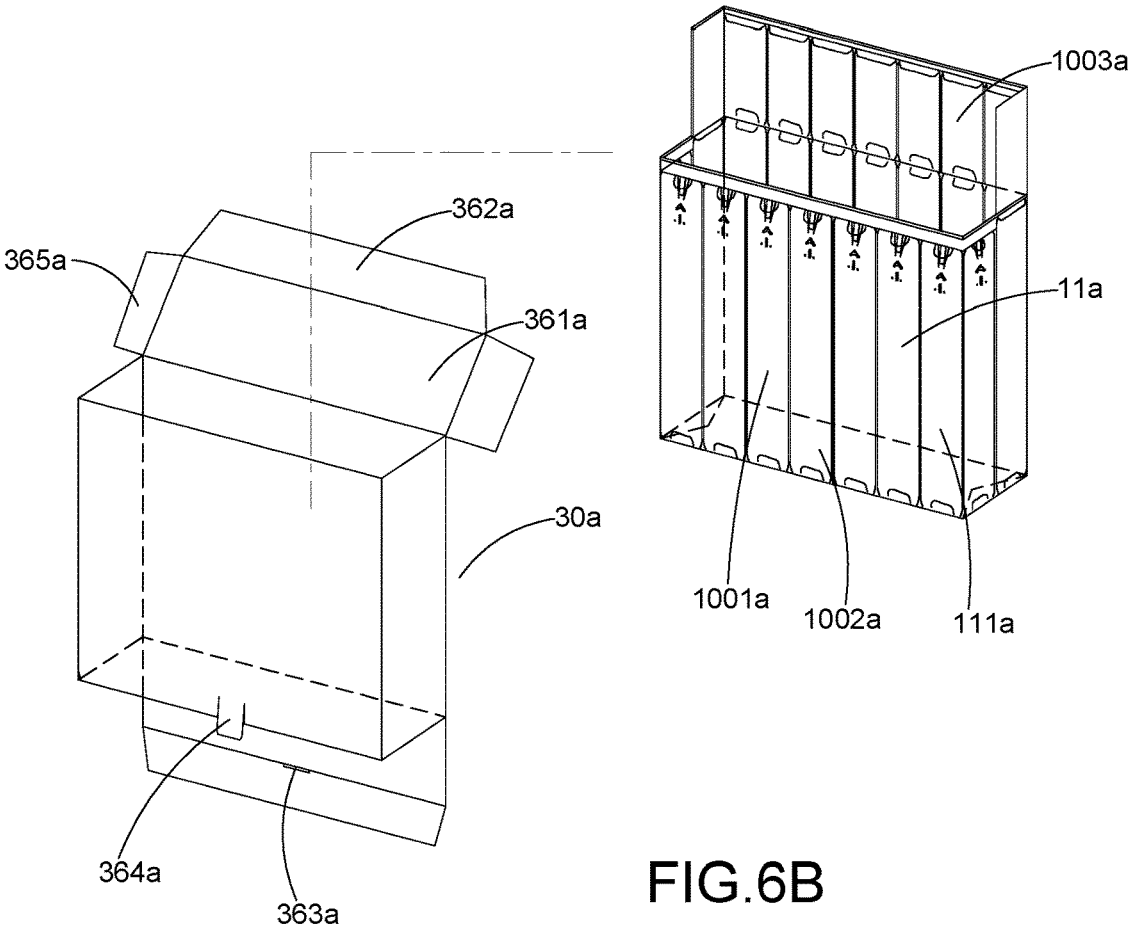
FIG. 6B is an exploded view of the above alternative mode of the inflatable main body of the air cushion packaging box according to the above first preferred embodiment of the present invention.
Figure 7:
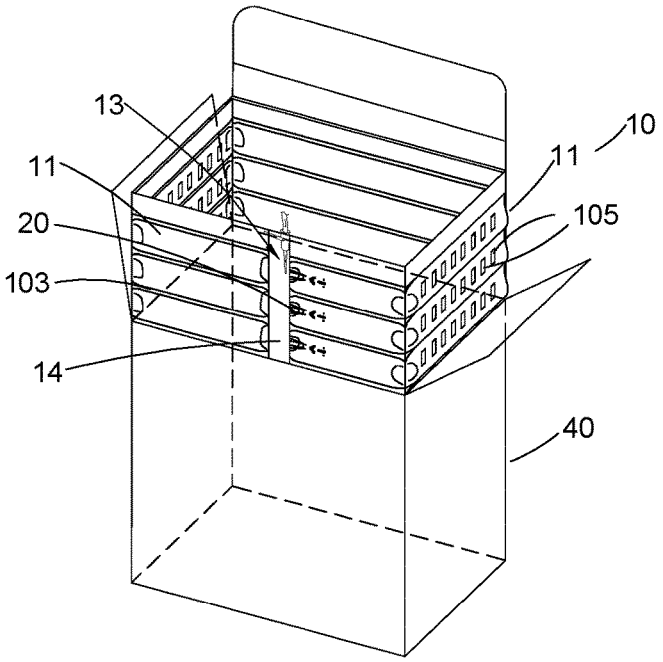
FIG. 7 is a perspective view of an air cushion packaging box in a packaging state according to a second preferred embodiment of the present invention.
Figure 8:
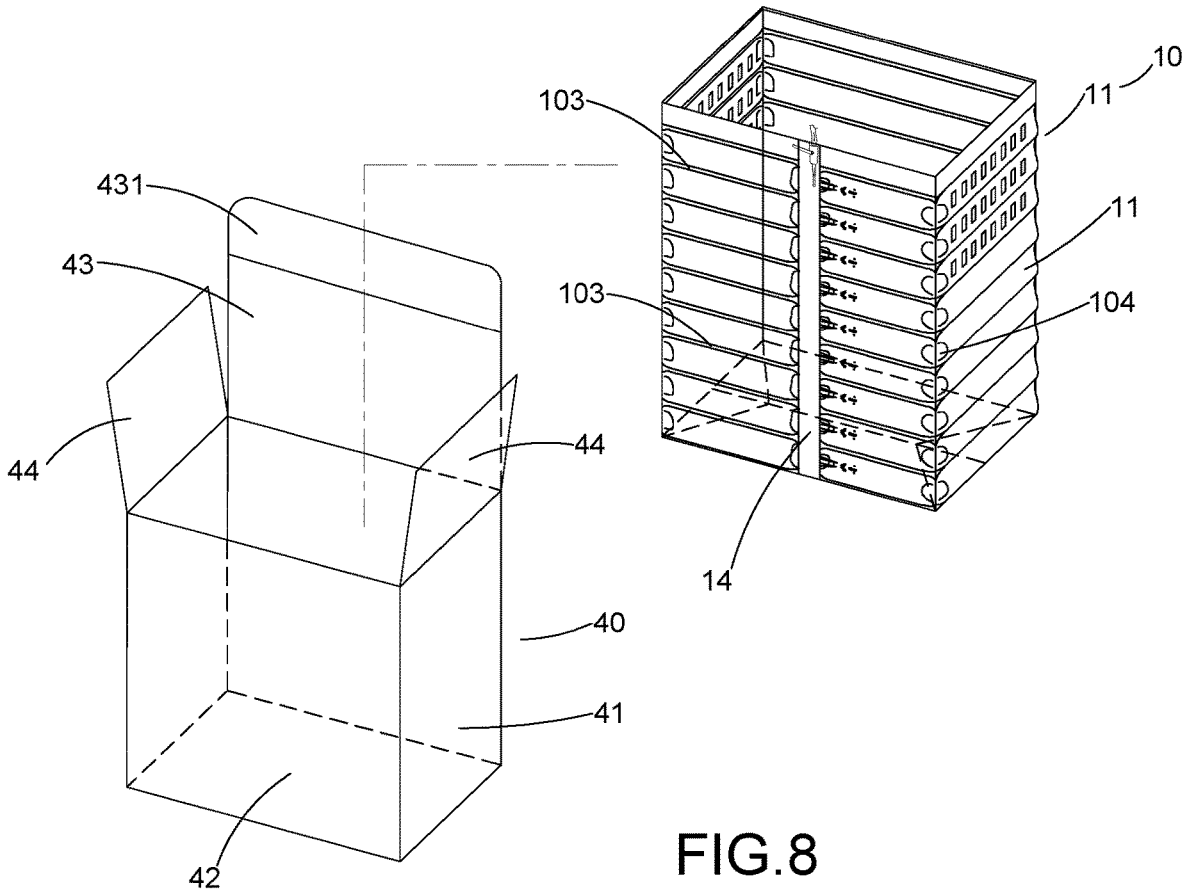
FIG. 8 is an exploded perspective view of the air cushion packaging box in a packaging state according to the above second preferred embodiment of the present invention.

FIG. 6A and FIG. 6B illustrate a packaging box according to an alternative mode of the preferred embodiment of the present invention. Similarly, the packaging box comprises at least one inflatable main body 10*a* and a box body 30*a*. The inflatable main body 10*a* is provided to the inner surface of the box body 30*a*, so as to form an integral structure. The inflatable main body 10*a* is used to supply air cushion to the packaged items.

According to the preferred embodiment of the present invention, the box body 30*a* comprises a main body 31*a* having four sides. The four sides are divided into two set. Two sides thereof correspond with the other two sides thereof. The box body 30*a* has a top opening 34*a* and a bottom opening 35*a*. Two ends of the box body 30*a* are respectively provided with a closing structure 36*a*, which are respectively used to close the top opening 34*a* and the bottom opening 35*a*. The closing structure 36*a* comprises a foldable sheet 361*a* pivotally extended to one side, such as a rear side of the main body 31*a* and a locating sheet 362*a* extended to (such as vertically and pivotally extended to) the foldable sheet 361*a*. While the opening is closing, the locating sheet 362*a* is suitable to be overlapped to the inner surface of another side, such as the front side of the main body 31*a*, so that the foldable sheet 361*a* is used to close the corresponding opening. The center of the connecting positon of the foldable sheet 361*a* and the locating sheet 362*a* can form a locating slot 363*a*. Another side, such as the front side of the main body 31*a* extends to form a locating tongue 364*a*. The locating tongue 364*a* is suitable to be inserted into the locating slot 363*a*, so as to play a clipping and locating function.

In addition, as shown in FIG. 6A, the closing structure 36*a* can further comprises two side wings 365*a* respectively extended to the foldable sheet 361*a*, which can be attached to the inner surface of the left and right sides of the main body 31*a*, while closing.

As shown in FIG. 6B, the inflatable main body 10*a* can have four surrounding walls 1001*a* formed by sub-inflatable cells 111*a* via dividing the inflatable cell 11*a* and a bottom wall 1002*a* extending among the four surrounding walls 1001*a* and a movable top wall 1003*a*. The movable top wall

1003*a* is used to seal the opening of the inflatable main body 10*a*. The opening thereof is used to put and get packaged items.

FIGS. 7-10 illustrate a packaging box according to a second preferred embodiment of the present invention. The packaging box comprises at least one inflatable main body 10 and a box body 40. The inflatable main body 10 is provided to the inner surface of the box body 40, so as to form an integrated structure. The inflating valve 20 is used to inflate air into the inflatable main body 10. The inflatable main body 10 is used to provide air cushion performance to the packaged items.

Figure 9:
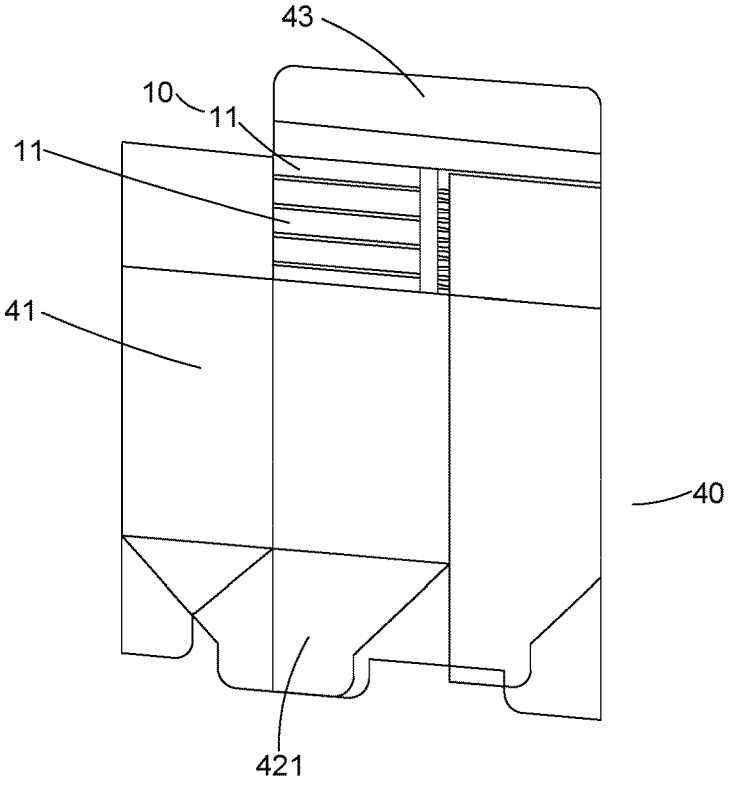
FIG. 9 is a perspective view of the air cushion packaging box in a deflated state according to the above second preferred embodiment of the present invention.
Figure 10:
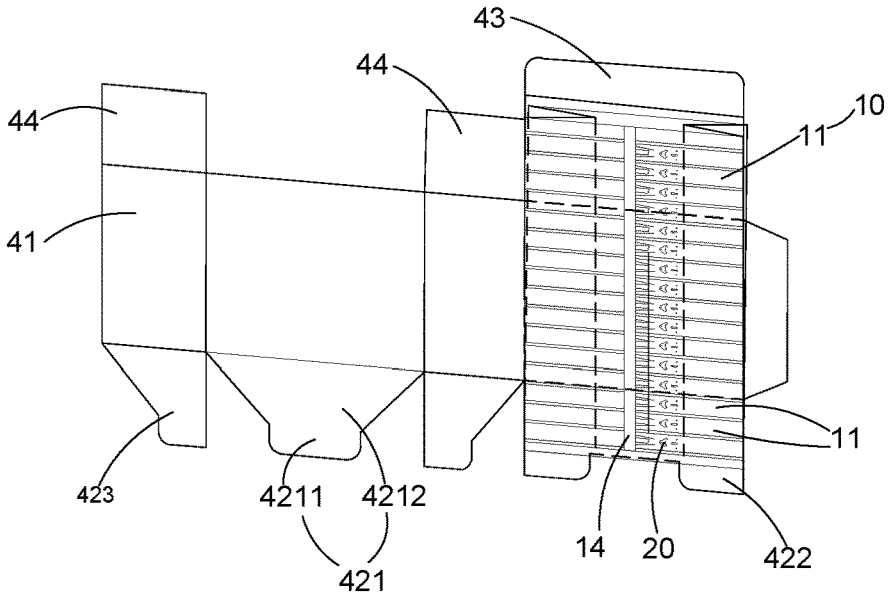
FIG. 10 is an exploded view of the air cushion packaging box in the deflated state according to the above second preferred embodiment of the present invention.

The box body 40 can be various package devices, such as quadrate paper packaging box comprising at least one side cover wall 41. The inflatable main body 10 is provided to the inner surface of the side cover wall 41. As shown in FIG. 9, it is worth mentioning that the side cover wall 41 is foldable, so that the box body 40 is foldable. While inflating to the inflatable main body 10, air enters into the air inflating channel 14 through the air inflating opening 13. Then the air inflating channel 14 guides air into each of the inflating valves 20, and then air enters into each of the inflatable cells 11. In other words, the air entered into the air inflating channel 14 through the air inflating opening 13 is distributed to each of the inflatable cells 11 through the air inflating channel 14. After air enters into each of the inflatable cells 11, each of the inflatable cells 11 is unfolded. More specifically, the sub-inflatable cells 111 of the inflatable cells 11 are unfolded first. After all of the sub-inflatable cells 111 are unfolded, all of the inflatable cells 11 are unfolded. After all of the inflatable cells 11 are unfolded fully, the inflatable cells 11 of the inflatable main body 10 surround a containing cavity, which is used to contain the packaged items. While the inflatable main body is inflated, the distance between the first chamber layer 101 and the second chamber layer 102 increases gradually. At the same time, press bored by the first chamber layer 101 and the 102 increase gradually. The inflatable cell 11 of the inflatable main body is unfolded gradually, so that the inflatable main body 10 is unfolded gradually. When the press produced while inflating the inflatable main body 10 to be unfolding is greater than the press bored by the side cover wall 41 of the box body 40 for remaining the folding state, the side cover wall 41 is unfolded. When the inflatable main body 10 is fully unfolded, the side cover wall 41 is unfolded fully, and the side cover wall 41 surrounds a containing space for containing the inflatable main body 10. At the same time, after the inflatable main body 10 of the inflatable main body 10 is unfolded, the press to the side cover wall 41 of the box body 40 is greater than the press for the side cover wall 41 to remain the unfolding state, so that the side cover wall 41 remains to an unfolding state. It is worth mentioning that while the box body 40 stays at a folding state, the inflatable main body 10 stays to a folding state too, so that before being used, air cushion packaging box has a small volume so as to be suitable to be stored and transported, so that the cost of transporting and storing is saved.

It is worth mentioning that the side cover wall 41 further comprises a set of sub-side cover walls 411. Each of the sub-side cover walls 411 respectively corresponds with the sub-inflatable cell 111 of the inflatable cell 11. According to the number of the sub-inflatable cells 111 formed by inflatable cell 11, the containing cavity forms various containing spaces. The side covers wall can 41 forms different shapes via the different position of the sub-side cover walls 411. In other words, the side walls of the inflatable main body 10 respectively correspond with the sub-side cover walls 411. According to the number of the side walls of the inflatable main body 10, the side cover walls 41 form different shapes via the sub-side cover wall 411.

The box body 40 further comprises a bottom cover wall 42. The edges of the bottom cover walls 42 connect with the side cover walls 41, so as to form a limiting end of the containing space while the side cover walls 41 are unfolded, so as to limit the position of the inflatable main body 10. The bottom cover wall 42 the inflatable main body 10. According to the preferred embodiment of the present invention, the bottom cover wall 42 further comprises a bulge cover wall 421 and a concave cover wall 422, the bulge cover wall 421 and the concave cover wall 422 respectively connect with two face-to-face sub-side cover walls 411, and can be rotated in the opposite direction. The bulge cover wall 421 further comprises a bulge portion 4211 and a connecting portion 4212. The connecting portions 4212 respectively connect with the sub-side cover wall 411 and the bulge portion 4211. The concave cover wall 422 has a notch 4221 and two blocking portions 4222. The blocking portions 4222 are respectively located to two sides of the notch 4221. The notch 4221 corresponds with the bulge portion 4211, so that the bulge portion 4211 insert into the notch 4221, so that the blocking portions 4222 snap the connecting portion 4212, so as to form a snap joint structure, so as to limit and support the inflatable main body 10. Preferably, the bottom of the notch 4211 connects with the bottom of the bulge portion 4211 at the position of the axle wire of the neighboring sub-side cover wall 411, so as to enhance the limiting and supporting affect. The bottom cover wall 42 further comprises a two pinna cover wall 423. The two pinna cover walls 423 are respectively provided to the bulge portion 4211 two neighboring and face-to-face sub-side cover walls 411. The pinna cover wall 423 further comprises a limiting portion 3241, so as to be used to limit the position of the bulge cover wall 4211, so as to enhance the stability of the snap joint structure being formed. To form the snap joint structure, the concave cover wall 422 is first rotated to the position parallel with the bottom edge of the side cover wall, and then the two pinna cover walls 423 are rotated respectively to make the two pinna cover walls 423 to contact with the concave cover wall 422. Then the bulge cover wall 421 is rotated in the direction of the concave cover wall 422 until the bulge portion 4211 of the bulge cover wall 421 is inserted into the notch 4221 of the concave cover wall 422, so that the bulge cover wall 421 is limited, so as to form the bottom cover wall 42 being provided to limit and support the inflatable main body 10.

The box body 40 further comprises a top cover wall 43. The top cover wall 43 is provided to the top portion edges of the side cover wall 41*s*, so as to cover the containing space being surrounded by the side cover walls. The top cover wall 43 can be rotated to the bottom cover wall 42. The top cover wall 43 further comprises a top portion 341. The top portion can be rotated, so that while the top cover wall covers the containing space, the top portion is inserted into the containing space and contact with the side cover wall 41 to form a press to avoid the top cover wall from rotating upward. The box body 40 further comprises two limiting cover walls 44, which are respectively provided to two sides of the top cover wall 43, so as to connect with two corresponding sub-side cover walls 411. The two limiting cover walls 44 can be rotated toward the containing space. While the top cover wall 43 covers the containing space, the two limiting cover walls 44 are first rotate to the containing space until to the position parallel with the top portion edges of the side cover wall 41, and then rotate the top cover wall 43 toward the containing space and make the top portion 341 to be inserted into the containing space and contact with the side cover wall 41. The two limiting cover walls 44 limits the top cover wall from rotating toward the containing space continuously, so as to protect the inflatable main body 10.

It is worth mentioning that the bottom cover wall 42 can apply a foldable self-closing structure. If the bottom cover wall applying the self-closing structure is applied, while the side cover wall 41 is unfolding, the bottom cover wall is unfolded along with the unfolding of the side cover wall. While the side cover wall 41 being unfolded, the bottom cover wall having the self-closing structure is unfolded, so as to limit the inflatable main body 10 and support the inflatable main body 10. As can be shown in FIG. 11A and FIG. 11B, the bottom of the box body 40 has a foldable self-closing structure.

According to a preferred embodiment of the present invention, the deflated inflatable main body 10 is fixed to a sub-side cover wall 411 of the side cover wall 41. In detail, a side wall of the deflated inflatable main body 10 is fixed to a sub-side cover wall 411 of the side cover wall 41. In other words, a paratactic sub-inflatable cell 111 of the paratactic inflatable cell 11 is fixed to at least one sub-side cover wall 411 of the side cover wall 41. Preferably, the width of the sub-side cover wall 411 corresponds with the width of the sub-inflatable cell. The sub-side cover wall 411 being used to fix the inflatable main body 10 is preferably the sub-side cover wall 411 connecting with the top cover wall 43. The outer surface of one sub-inflatable cell 111 of one list of the paratactic the sub-inflatable cells 111 contacting with the sub-side cover wall 411 is fixed to the sub-side cover wall 411. It is also possible to fix some sub-inflatable cells 111 of the paratactic sub-inflatable cell 111 are fixed to the sub-side cover wall 411. It is also possible to fix the whole list of the sub-inflatable cells 111 to the sub-side cover wall 111'. Preferably, the sub-inflatable cells 111 are spliced to the sub-side cover wall 411.

While inflating into the inflatable main body 10, if just a list of sub-inflatable cells 111 are connected to the sub-side cover wall 411, the inflatable main body 10 will be unfolded with respect to a center of the sub-side cover wall 411 connecting with the sub-inflatable cell 111. While inflating the inflatable main body 10, air enters into the air inflating channel 14 through the air inflating opening 13. Then the air inflating channel 14 guides air into each of the corresponding inflating valves 20, so that the air enters into each of the inflatable cells 11. In other words, air entered into the air inflating channel 14 through the air inflating opening 13 is distributed into each of the inflatable cells 11 through the air inflating channel 14. After air enters into each of the inflatable cells 11, each of the inflatable cells 11 is unfolded. More specifically, the sub-inflatable cells 111 of the inflatable cell 11 are unfolded first. It is worth mentioning that, while being unfolded, the inflatable main body 10 will be unfolded with respect to a center of the sub-side cover wall 411 connecting with the sub-inflatable cell 111. At the process of the inflatable main body 10 being unfolded, the press is applied to each of the sub-side cover walls 411 so as to drive the sub-side cover wall 411 being unfolded, so that the side cover wall 41 is unfolded outwardly, so as to form the containing space being used to contain the inflatable main body 10. While the side cover wall 41 being unfolded outwardly, the side cover wall 41 drives the bottom cover wall 42 having the self-closing structure to be unfolded. When the side cover wall 41 is unfolded, the bottom cover wall 42 is unfolded too, so as to limit and support the inflatable main body 10. When all of the sub-inflatable cells 111 are unfolded, all of the inflatable cells 11 are unfolded. When all of the inflatable cells 11 are unfolded, the inflatable cells 11 of the inflatable main body 10 surround a containing cavity, which is used to contain the packaged items. While inflating air into the air cushioning device, the distance between the first chamber layer 101 and the second chamber layer 102 increases gradually. At the same time, the pressure bored by the first chamber layer 101 and the second chamber layer 102 increases gradually. The inflatable cell 11 of the inflatable main body 10 is unfolded gradually, so as to drive the inflatable main body 10 being unfolded gradually. When the press produced while inflating the inflatable main body 10 to be unfolding is greater than the press bored by the side cover wall 41 of the box body 40 for remaining the folding state, the inflatable main body drives the side cover wall 41 to be unfolded, and the inflatable main body supports the side cover wall 41. While the inflatable main body 10 is unfolded, the side cover wall 41 is fully unfolded too.

According to one embodiment of the present invention, whiling the side cover wall 41 being drove, two sub-side cover walls 411 neighboring with the sub-side cover wall 411 of the side cover wall 41 are rotate in a same direction, so as to drive the side cover wall 41 unfolding, so that the side cover wall 41 surrounds the containing cavity.

It is worth mentioning that the side walls of the inflatable main body 10 are fixed to corresponding sub-side cover walls 411 of the side cover wall 41. One or more inflatable main bodies 10 can be provided into the box body 40.

It is worth mentioning that the inflatable main bodies 10 can be respectively provided to the inner sides of the side cover wall 41, the bottom wall 42 having self-closing structure and the top wall 43 of the box body 40, so that after the box body 40 is unfolded, the containing cavity is formed by the inflatable main bodies 10.

FIGS. 11C-11G illustrate an air cushion packaging box according to a second alternative mode of second preferred embodiment of the present invention. The packaging box comprises at least one inflatable main body 10 and a box body 50. The box body 50 is a paper box body. The box body 50 comprises a plurality of side walls 51, a top cover wall 52 and a bottom cover wall 53. While being pushed to open, the box body 50 forms a containing space having a roughly cuboid shape. Both ends of the box body are able to be closed. The box body has a bottom self-closing structure.

As can be shown in the drawings, the bottom cover wall 53 comprises two snapping walls 531 being suitable to be snapped and two corresponding closing walls 532. The snapping walls respectively have at least one gap 533. While overlapping, two snapping walls 531 snap with each other via the gaps 533. The two closing walls 532 overlap with corresponding snapping walls in part of in whole, so as to close the bottom of the box body.

Figure 11A:
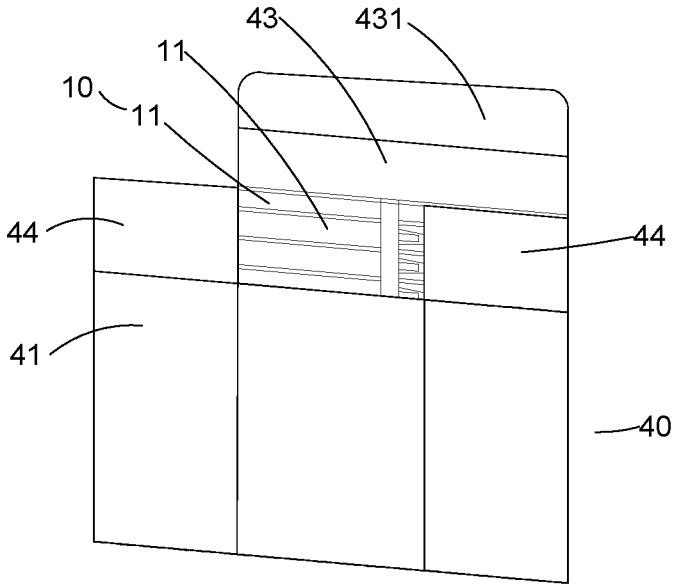
FIG. 11A is a perspective view of a first alternative mode of the air cushion packaging box according to the above second preferred embodiment of the present invention.
Figure 11B:
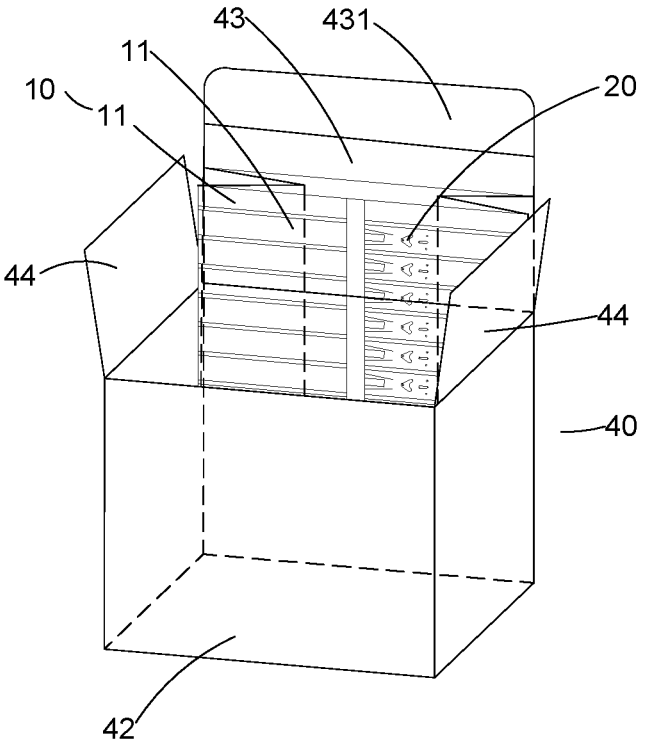
FIG. 11B is a perspective view of the above first alternative mode of the air cushion packaging box according to the above second preferred embodiment of the present invention.
Figure 11C:
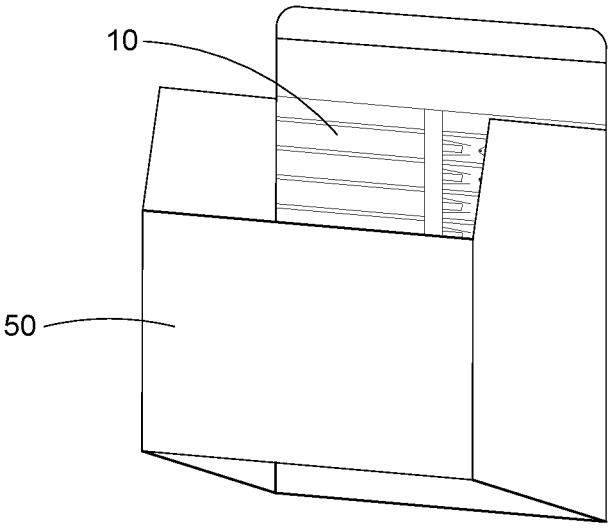
FIG. 11C is a perspective view of an air cushion packaging box according to a second alternative mode of the above second preferred embodiment of the present invention, wherein the air cushion packaging box is not inflated.
Figure 11D:
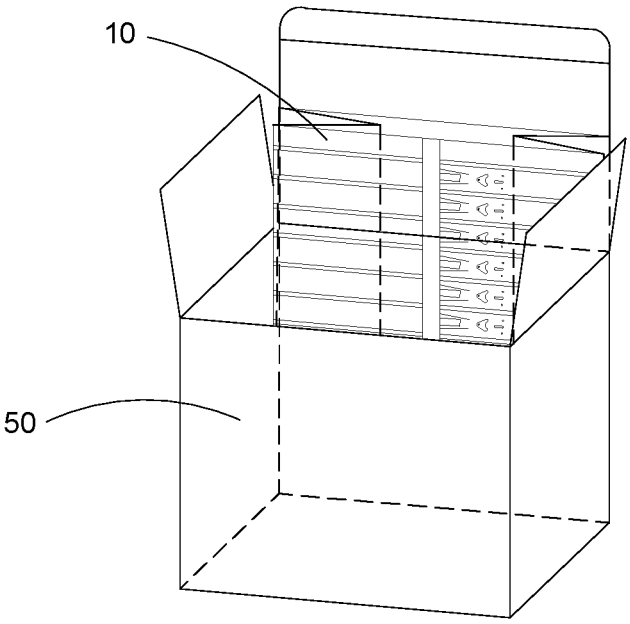
FIG. 11D illustrates the air cushion packaging box according to above second alternative mode of above second preferred embodiment of the present invention, wherein a box body of the air cushion packaging box is pushed to open.
Figure 11E:
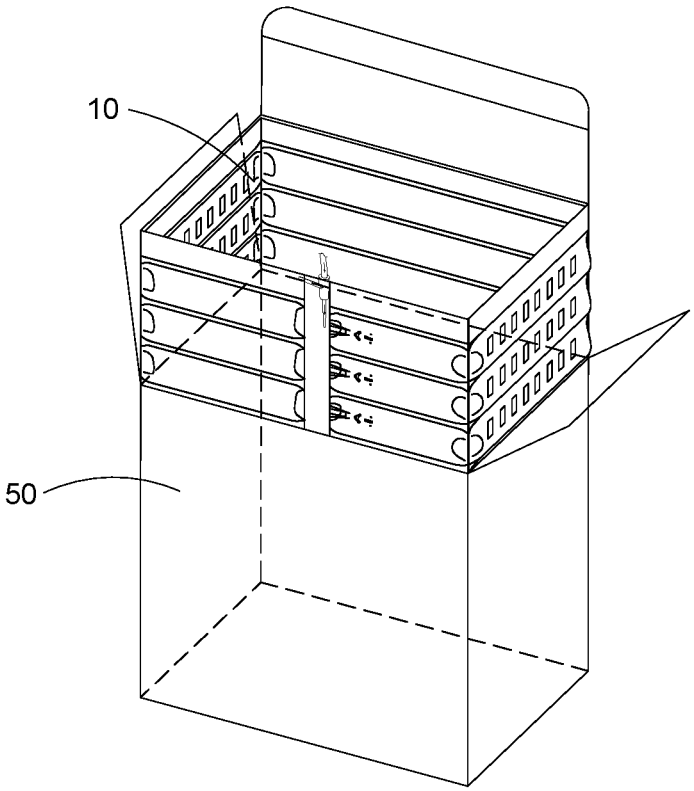
FIG. 11E illustrates the air cushion packaging box according to above second alternative mode of above second preferred embodiment of the present invention, wherein the box body of the air cushion packaging box is pushed to open via an inflatable main body of the air cushion packaging box.
Figure 11F:
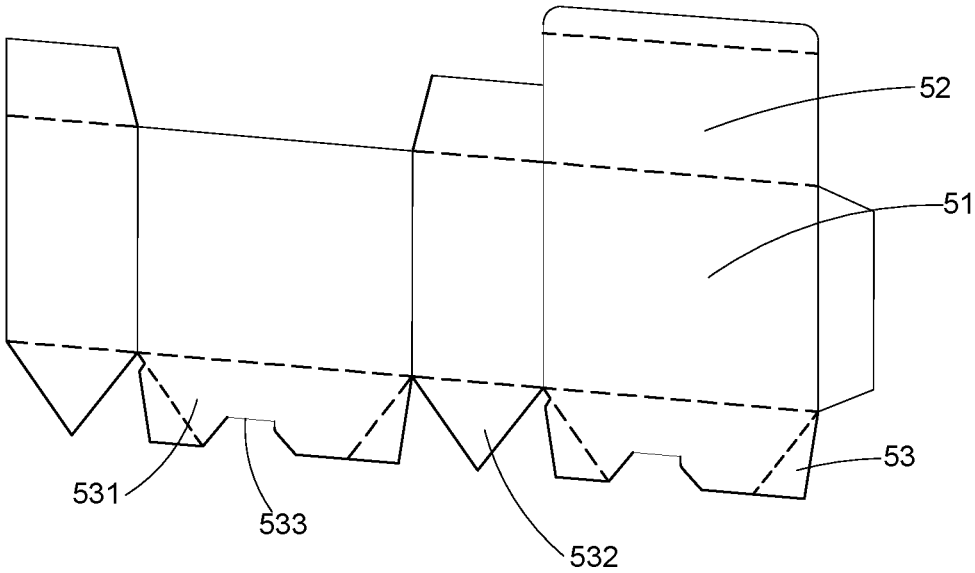
FIG. 11F illustrates the box body of the air cushion packaging box according to above second alternative mode of above second preferred embodiment of the present invention.
Figure 11G:
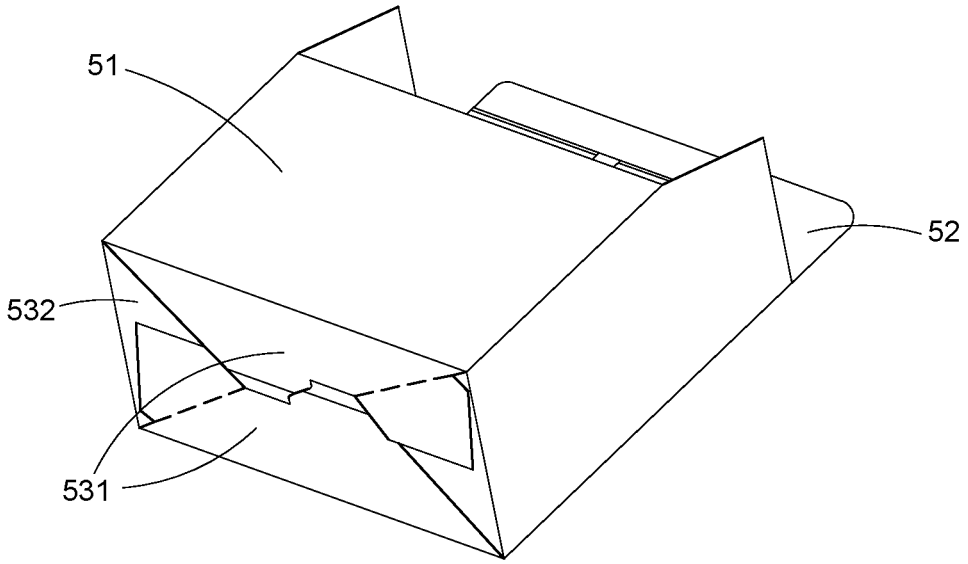
FIG. 11G illustrates a bottom self-closing structure of the box body of the air cushion packaging box according to above second alternative mode of above second preferred embodiment of the present invention.
Figure 11H:
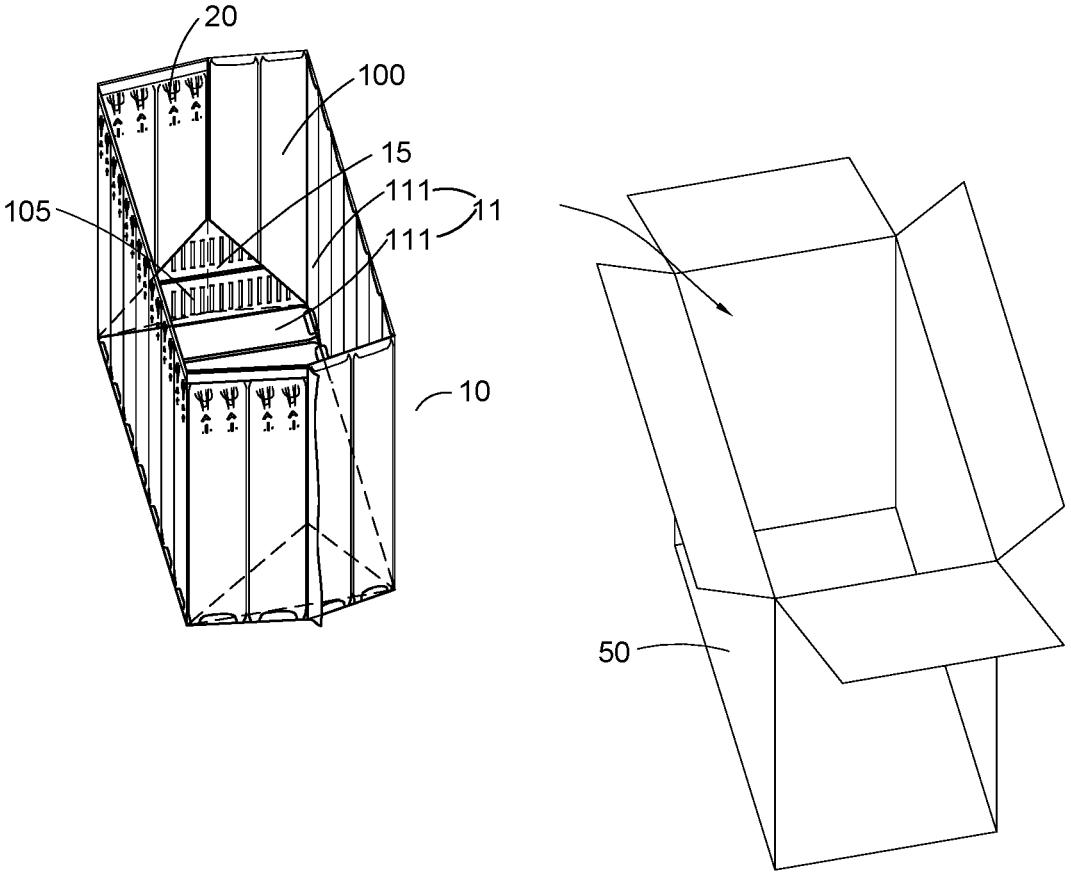
FIGS. 11H and 11I illustrate a third alternative mode of the air cushion packaging box according to the above second preferred embodiment of the present invention.
Figure 11I:
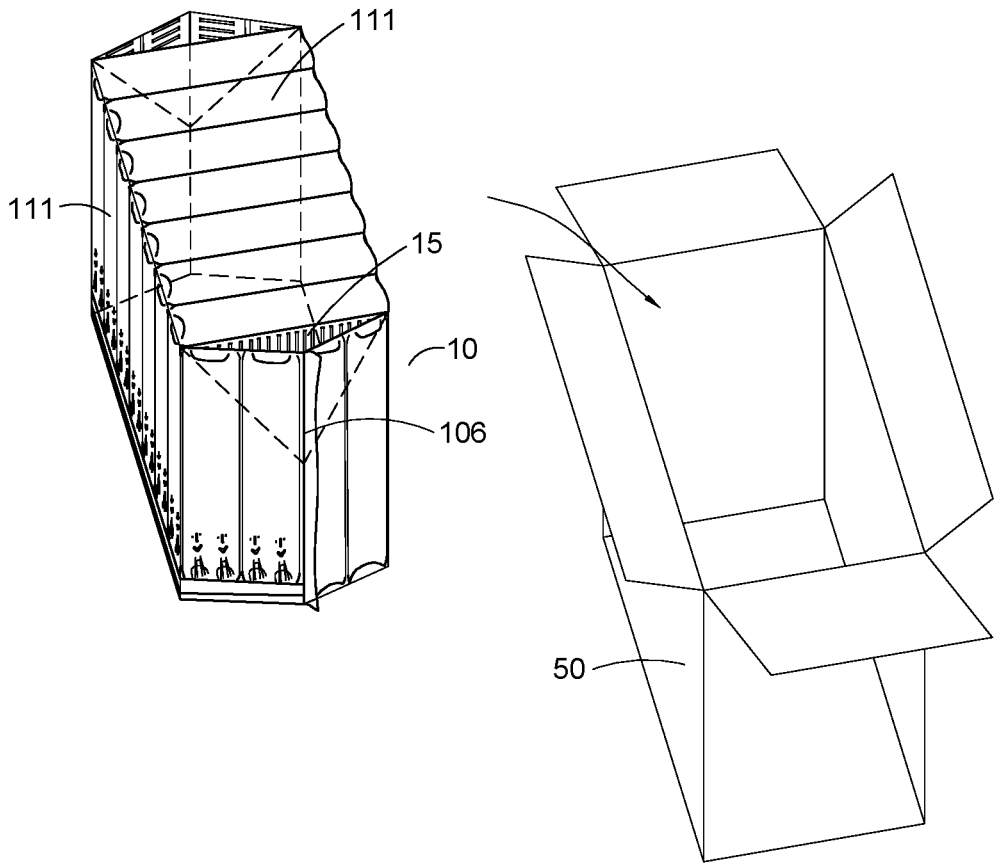

FIGS. 11H and 11I illustrate a third alternative mode of the air cushion packaging box according to the second preferred embodiment of the present invention. The foldable unit 15 form in the corner of the packaging bag formed by the inflatable main body is suitable to be bonded to the side walls of the packaging bag via at least one end sealing seam 106. The end sealing seam 106 can be a continuous sealing line or an interrupted sealing line. The foldable unit 15 is provided in such a manner that the packaging bag forms a roughly cuboid shaped containing cavity being used to contain packaged items.

Figure 12A:
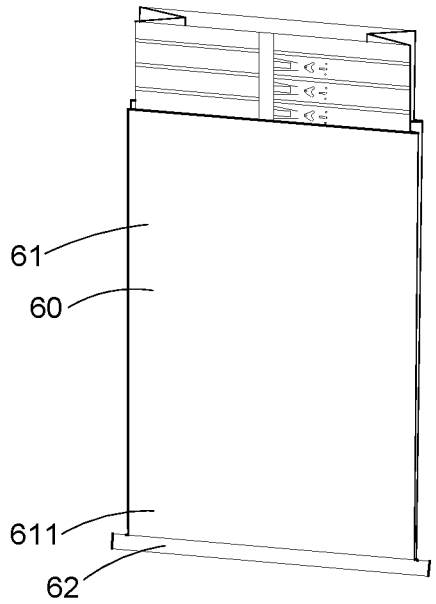
FIG. 12A illustrates an air cushion packaging box according to a fourth alternative mode of the above second preferred embodiment of the present invention, wherein the air packaging box is not inflated.
Figure 12B:
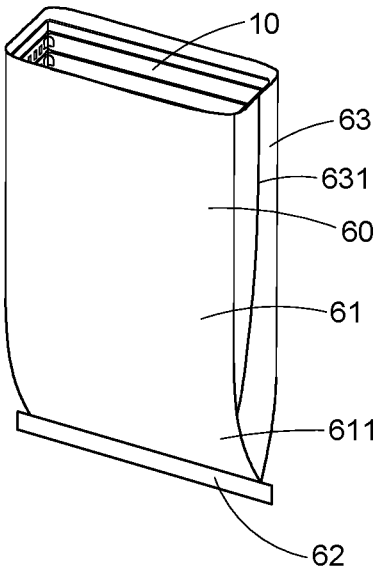
FIG. 12B illustrates the air cushion packaging box according to the above fourth alternative mode of the above second preferred embodiment of the present invention, wherein the air packaging box is inflated.
Figure 12C:
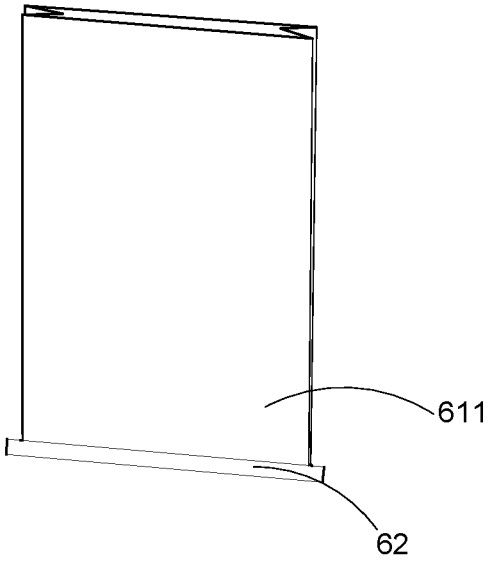
FIG. 12C illustrates the structure of a box body of the air cushion packaging box according to the above fifth alternative mode of the above second preferred embodiment of the present invention.

FIGS. 12A-12C illustrate a fourth alternative mode of the air cushion packaging box according to the second preferred embodiment of the present invention. The air cushion packaging box comprises at least one inflatable main body 10 and a box body 60. The box body 60 is a soft craft paper bag comprising two side cover walls 61 overlapping with each other and two foldable walls 63 respectively connecting with the side cover walls 61. Each foldable wall 63 provides at least one folding line 631. Before the inflatable main body 10 is inflated, the box body 60 can be folded along the folding lines.

In addition, the bottom ends 611 of the two side cover walls 61 can be bonded together in a manner, such as via adhesives. In addition, the box body 60 can further comprise a closed end 62 being suitable to be covered by the bottom ends 611 of side cover walls 61 of the box body 60. The closed end 62 can be bonded to the bottom ends in a manner, such as a splicing manner, so as to make the bottom of the box body 60 keeping in a close state.

Figure 12D:
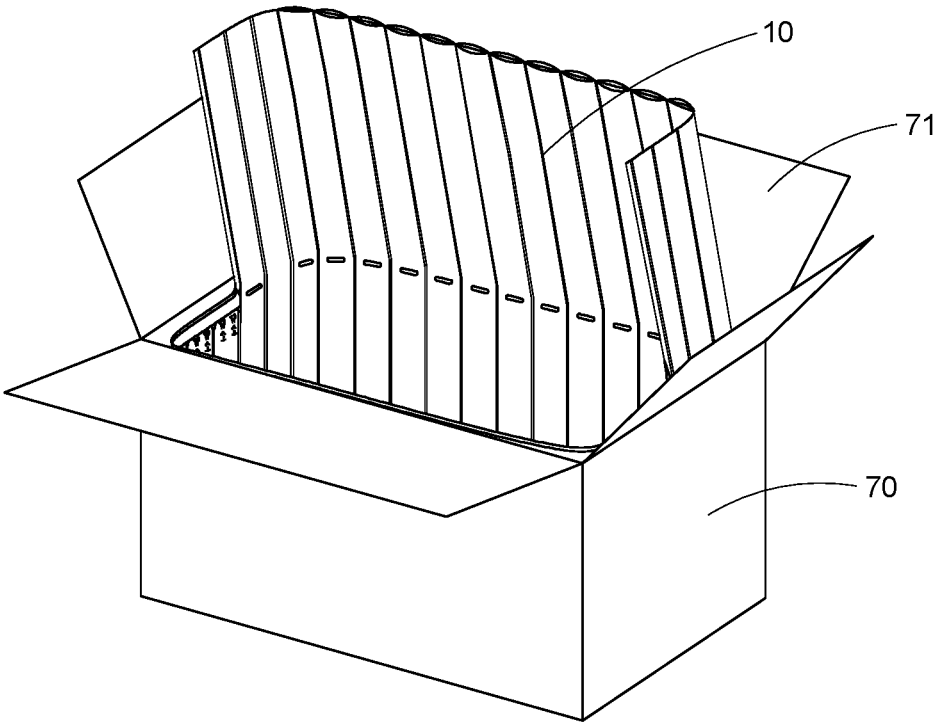
FIGS. 12D-12F illustrate an air cushion packaging box according to a fifth alternative mode of the above second preferred embodiment of the present invention.
Figure 12E:
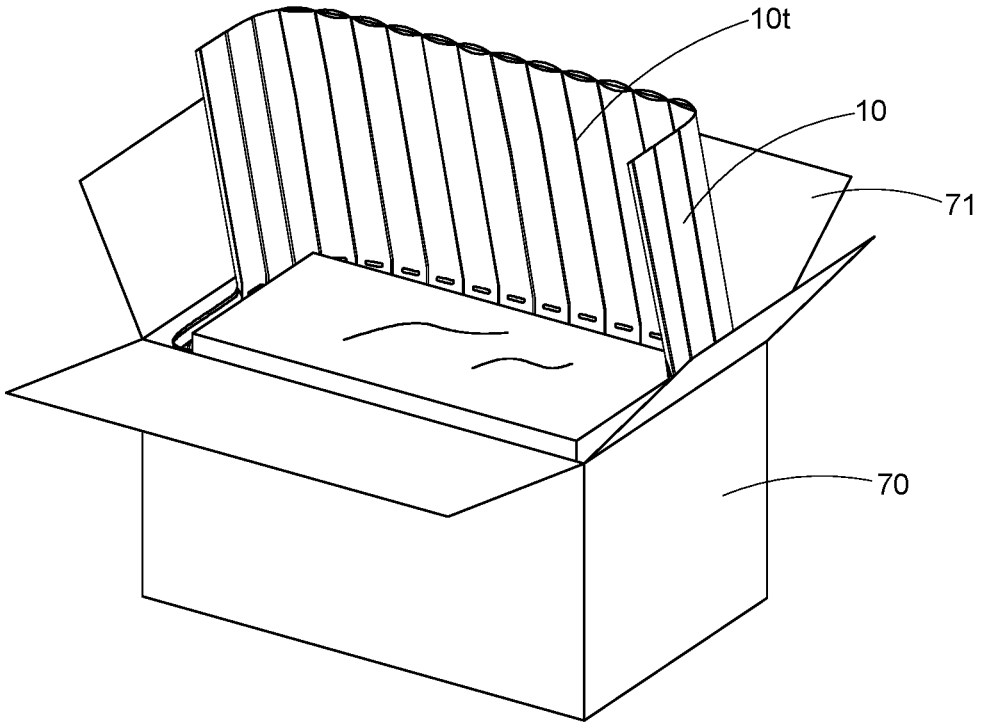
Figure 12F:
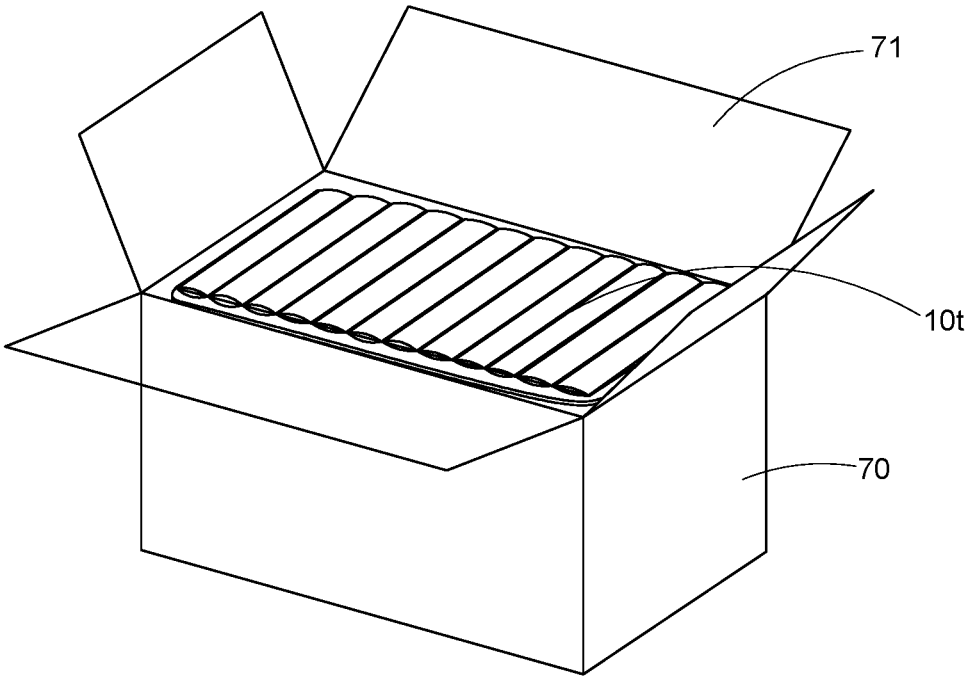

FIGS. 12D-12F illustrate a fifth alternative mode of the air cushion packaging box according to the second preferred embodiment of the present invention. The air cushion packaging box comprises at least one inflatable main body 10 and a box body 70. The box body 70 is a standard paper box. Either the top or the bottom of the box body can be closed by overlapping four top cover walls of four bottom cover walls 71. The inflatable main body 10 forms an inflatable bag. The inflatable main body 10 further has a top inflatable wall 10*t*. After being inflated, the top inflatable is suitable to overlap the packaged items and is further pressed by the top cover walls 71 of the box body 70, so as to provide cushion effect at more than one side of the packaged items.

Figure 13:
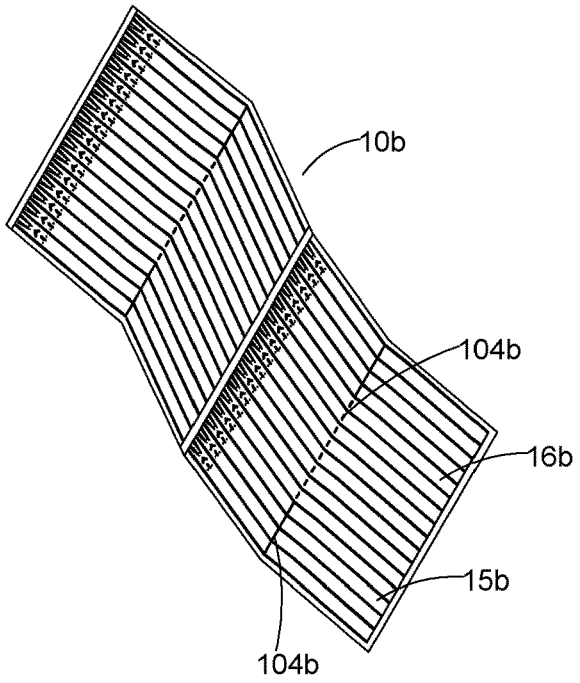
FIGS. 13-29 are schematic views of other alternative modes of the inflatable main body of the air cushion packaging box according to the above second preferred embodiment of the present invention.
Figure 14:
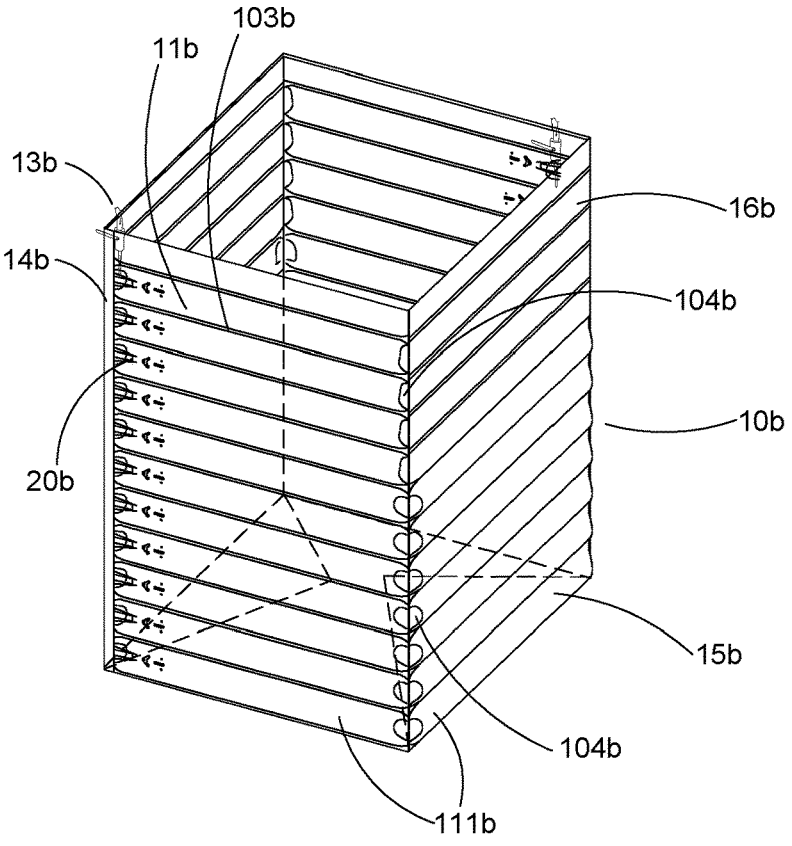

FIGS. 13-14 illustrates another inflatable main body 10*b*, which can be used to attach into the box body 30 of the packaging box according to the present invention. The inflatable cells 11*b* at two sides of the inflatable main body 10*b* respectively form un-inflatable portions, so after the air cushion packaging box is inflated, an un-inflatable pinna 15*b* can be formed in the corner. The un-inflatable pinna 15*b* can be inserted into the containing cavity of the air cushion packaging box. The un-inflatable pinna 15*b* further forms a containing space being used to contain and connect bottom corner of the box body 30*b*. In addition, As shown in FIG. 6D, four sides are formed to the top side of the inflatable main body 10*b*, which comprises inflatable cells 11*b* being provided face-to-face and un-inflatable portion 16*b* being provided face-to-face. Due to the un-inflatable portion 16*b* is provided, the other two sides being provided with the inflatable cells 11*b* can be folded downwardly, so as to seal the opening of the air cushion packaging box. It is worth mentioning that, the corresponding un-inflatable pinna 15*b* and un-inflatable portion 16*b* according to the present invention can be replaced by formed by a plurality of small inflatable room having minor diameter, thus partial portions of the air cushion packaging box can be folded.

In other words, if the size of the dividing seam 104*b* being provided to two sides of each of the sub-inflatable cells 111*b* of the un-inflatable pinna 15*b* and the un-inflatable portion 16*b*, so as to fully seal corresponding sub-inflatable cell 111*b*, so as to form an un-inflatable cell. It is worth mentioning that after the inflating is finished, the un-inflatable cell being formed by the un-inflatable portion 16*b* are folded inwardly. The front side wall and the rear side wall approach with each other, so as to seal the top opening of the air packaging bag formed by the inflatable main body 10*b*.

Figure 15:
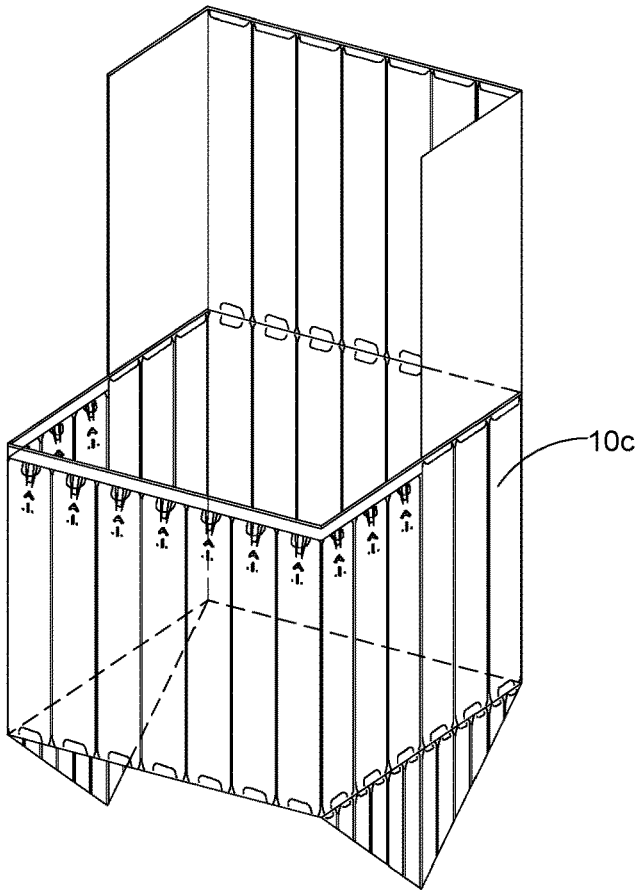
Figure 16:
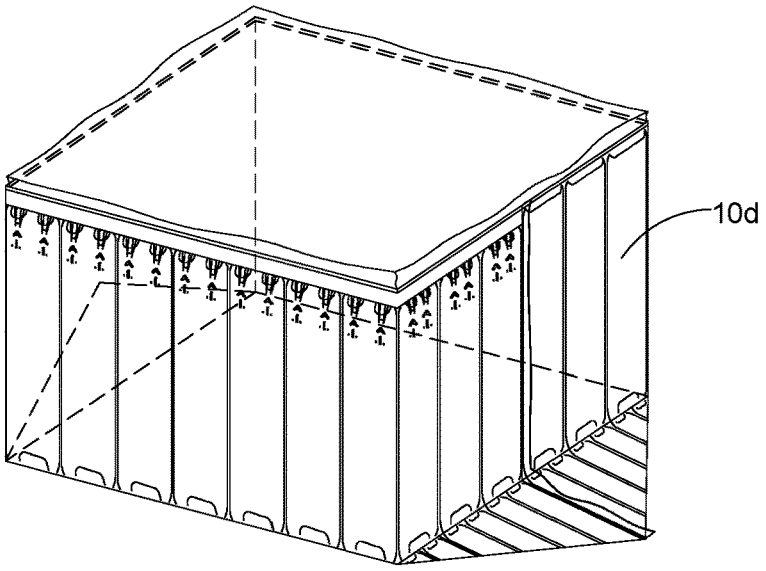

FIGS. 15-16 illustrate inflatable main bodies 10*c* and 10*d* according to other embodiments, which can be provided into the box body 10 of the packaging box according to the present invention, which comprises four surrounding walls and a bottom wall. The inflatable main body 10*c* illustrated in FIG. 15 has a movable top wall which is used to seal the opening. The inflatable main body 10*d* illustrated in FIG. 16 is not provided with the movable top wall which is used to seal the opening.

Figure 17:
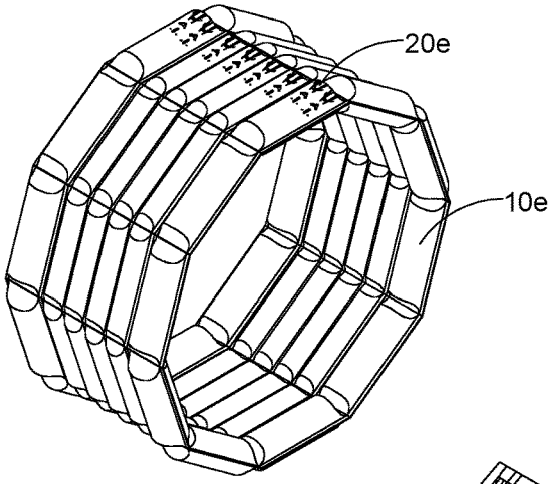

FIG. 17 illustrates an inflatable main body 10*e* according to other embodiments, which can be provided into the box body 10 of the packaging box according to the present invention too. According to this alternative mode, the head end and the tail end of the inflatable main body 10*e* are sealed together, so as to be suitable to surround the packaged items, so that the inflatable main body 10*e* can form a packaging device supporting the edges of the items.

In other words, according to the alternative mode, the inflatable main body 10*e* can do without the top wall and the bottom wall. The inflatable main body 10*e* only surrounds the packaged items. The inflatable cells 11*e* of the inflatable main body 10*e* can have some bigger inflatable rooms and some smaller inflatable rooms, wherein the bigger inflatable rooms and the smaller inflatable rooms are arranged alternatively. For example, according to the alternative mode, the smaller inflatable rooms are provided in the middle and the bigger inflatable rooms are provided to two sides, so that the packaged items are suitable to be blocked to the middle position of the inflatable main body 10*e*, and the bigger inflatable rooms play a role of tightening the openings at two sides, so as to avoid the packaged items from being slipped.

In addition, it is worth mentioning that the bigger and smaller inflatable room can be obtained by the following method: the bigger inflatable rooms can provide two or more inflating valves 20*e*; the smaller inflatable rooms can provided with one inflating valve 20*e*. Of course, each of the bigger inflatable rooms and each of the smaller inflating rooms all can be provided with one inflating valve 20*e*, wherein the width and size thereof is different.

Figure 18:
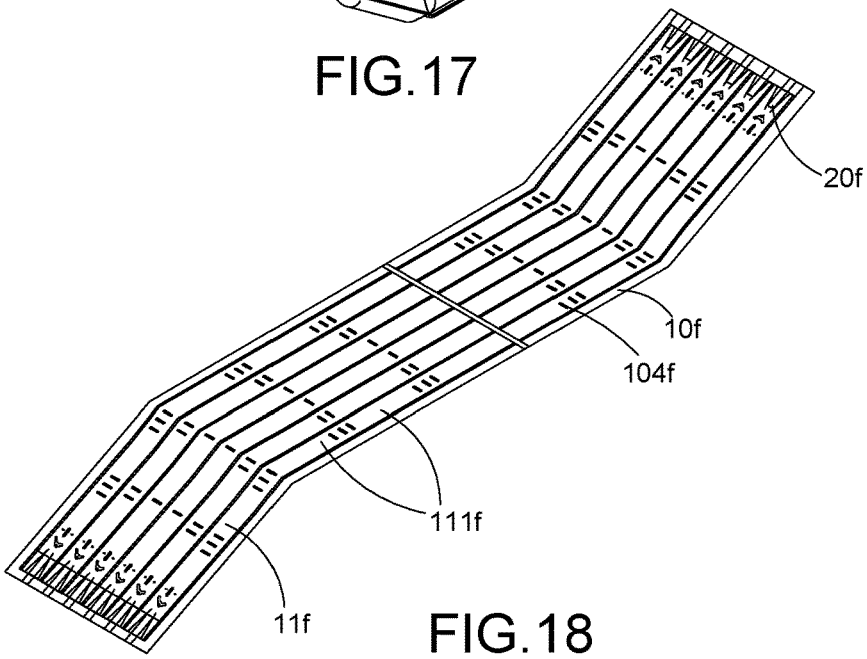
Figure 19:
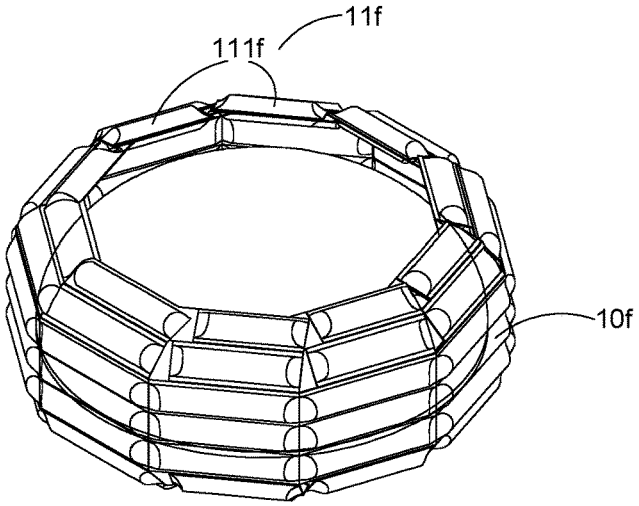
Figure 20:
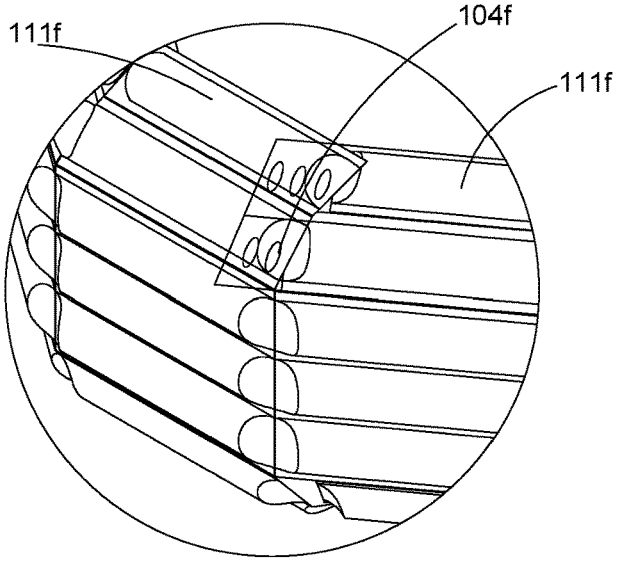

FIGS. 18-20 illustrate an inflatable main body 10*f* according to another embodiment, wherein to divide the inflatable cell 11*f* to obtain the sub-inflatable cells 111*f*, a plurality of dividing seams 104*f* are provided between two neighboring sub-inflatable cells 111*f* near the opening of the inflatable main body 10*f*. Thus after the inflating is finished, one end of one of the neighboring sub-inflatable cells 111*f* is pressed to one end of the other sub-inflatable cell 111*f*, so as to tighten the opening, As shown in FIG. 20.

It is worth mentioning that while the inflatable main body 10*f* is provided into the box body 30 of the packaging box and being inflated, the box body 30 press these sub-inflatable cells 111*f* near the opening of the inflatable main body 10*f*, so that one end of one of the neighboring sub-inflatable cells 111*f* is pressed to one end of the other sub-inflatable cell 111*f* easily, so as to tighten the opening and avoiding the packaged items from slipping out of the packaging box.

Figure 21:
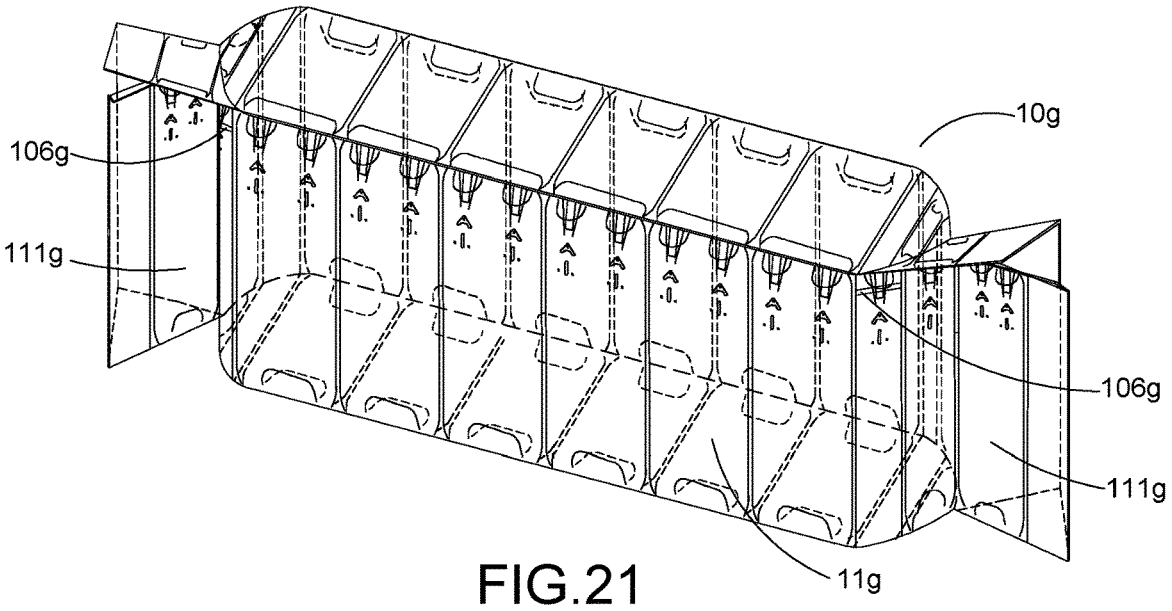

FIG. 21 illustrates an inflatable main body 10*g* according to another embodiment. While the inflatable main body 10*g* being heat sealed, the sub-inflatable cells 111*g* at two ends thereof can form a side pressing air room. The outer inflatable cell can be provided with heat sealing 106*g*, and the two side pressing air rooms are not inflated, so that the inflatable main body 10*g* can contain different packaged items.

Figure 22:
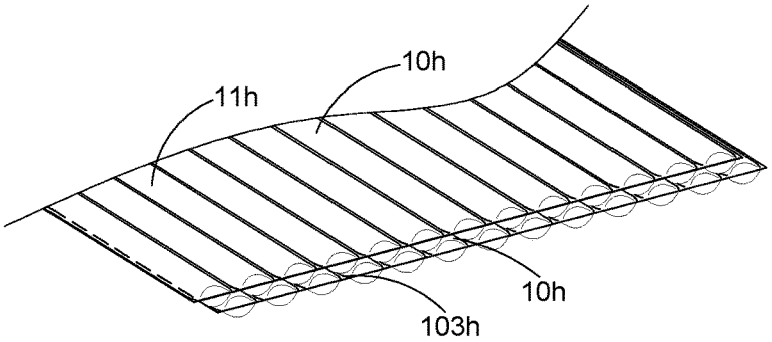
Figure 23:
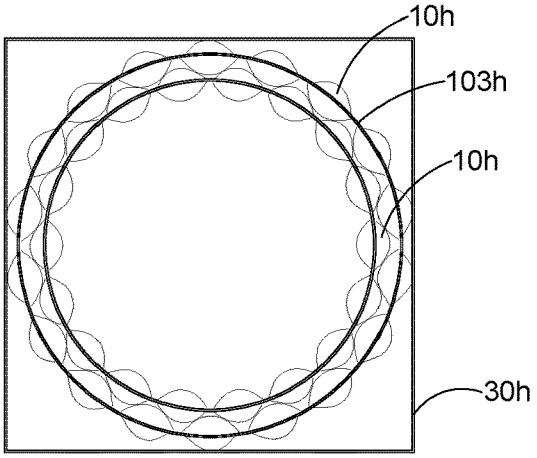

As shown in FIG. 22 and FIG. 23, the packaging box can comprises two inflatable main bodies 10*h* being bonded together. According to this embodiment, the inflatable cell 11*h* of one inflatable main body 10*h* face to the connecting seal 103*h* of the inflatable main body 10*h*. In other words, the inflatable cells 11*h* of the two inflatable main bodies 10*h* can be provided stagger in an alternating manner, so that the cushion affect can be enhanced. In other words, the inner layer inflatable main body 10*h* form can form an indent structure via the connecting seal 103*h*. Via the reinforcing affection of the inflatable cell 11*h* of the other outer inflatable main body 10*h*, the air cushion affect is enhanced.

It is worth mentioning that this kind of structure can provide a heat preservation effect. The structure of two layer stagger the air columns, so the air conduction will not be occurred via the connecting seal 103*h*, so as to effectively avoid heat exchanging of outside of the inflatable main body 10*h* and inside of the inflatable main body 10*h*.

Figure 24:
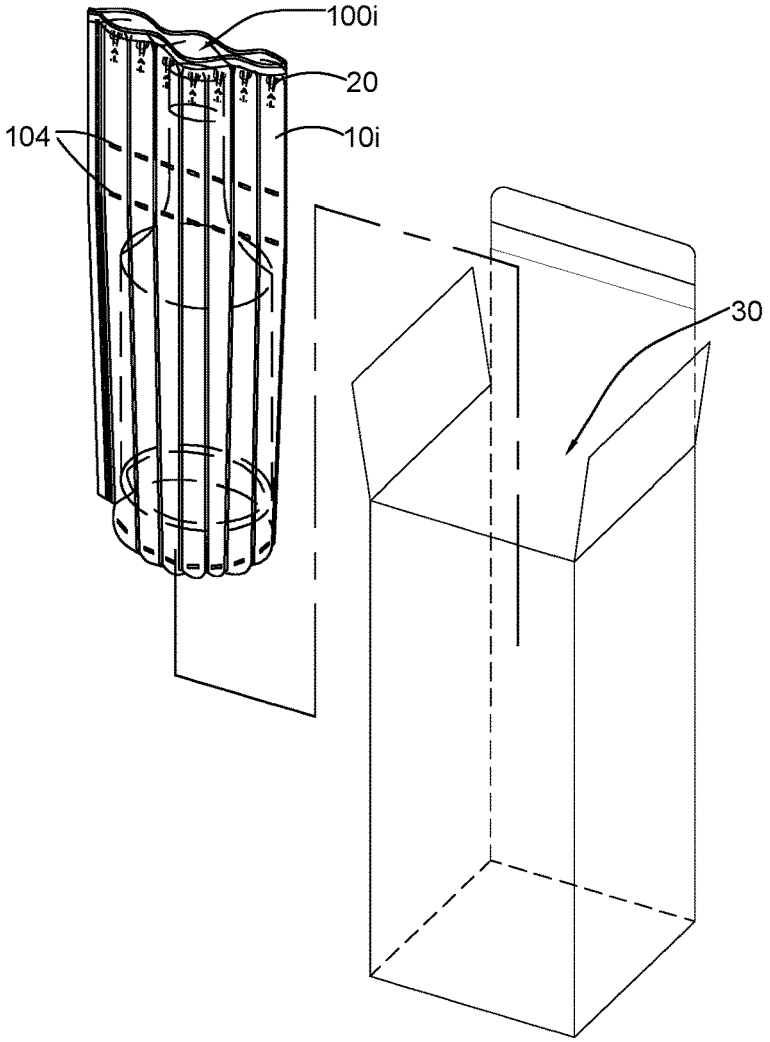
Figure 25:
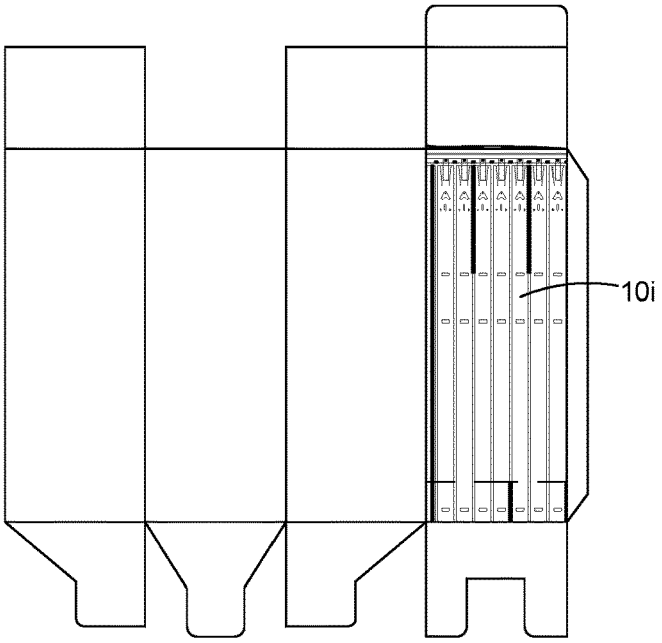
Figure 26:
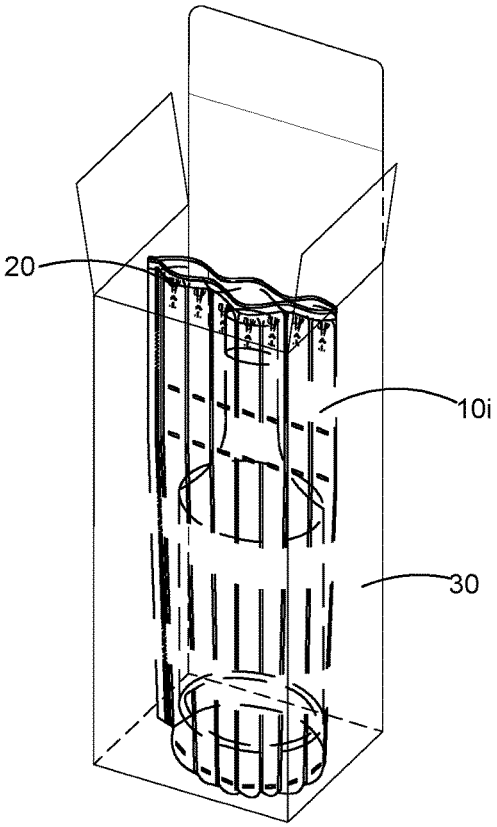

As shown in FIGS. 24-26, the packaging box can be suitable to be used to package long items, such as red wine or lamps. Correspondingly, the inflatable main body 10*i* is provided into the box body 30. After being inflated, the inflatable main body 10*i* forms a long containing cavity 100*i*, so as to be suitable to contain long items into the containing cavity 100*i*.

Figure 27:
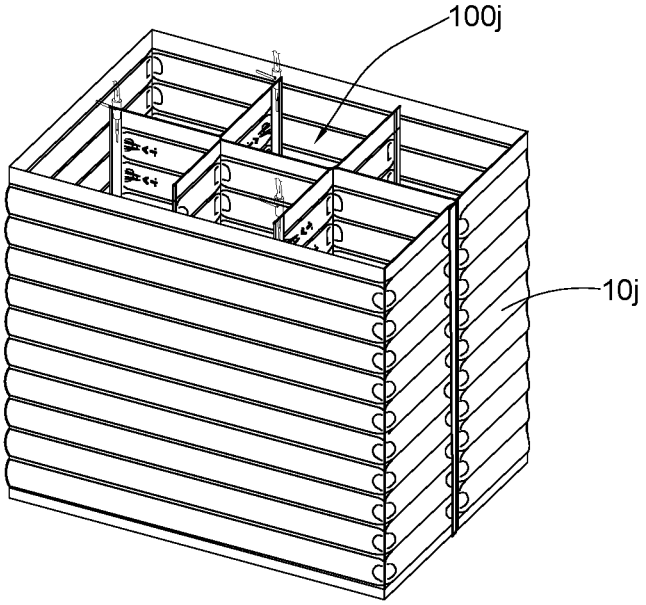
Figure 28:
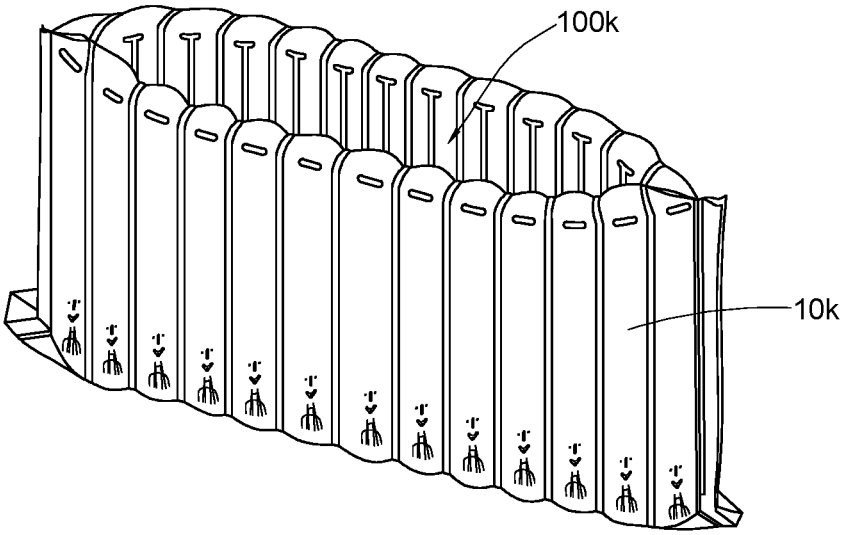
Figure 29:
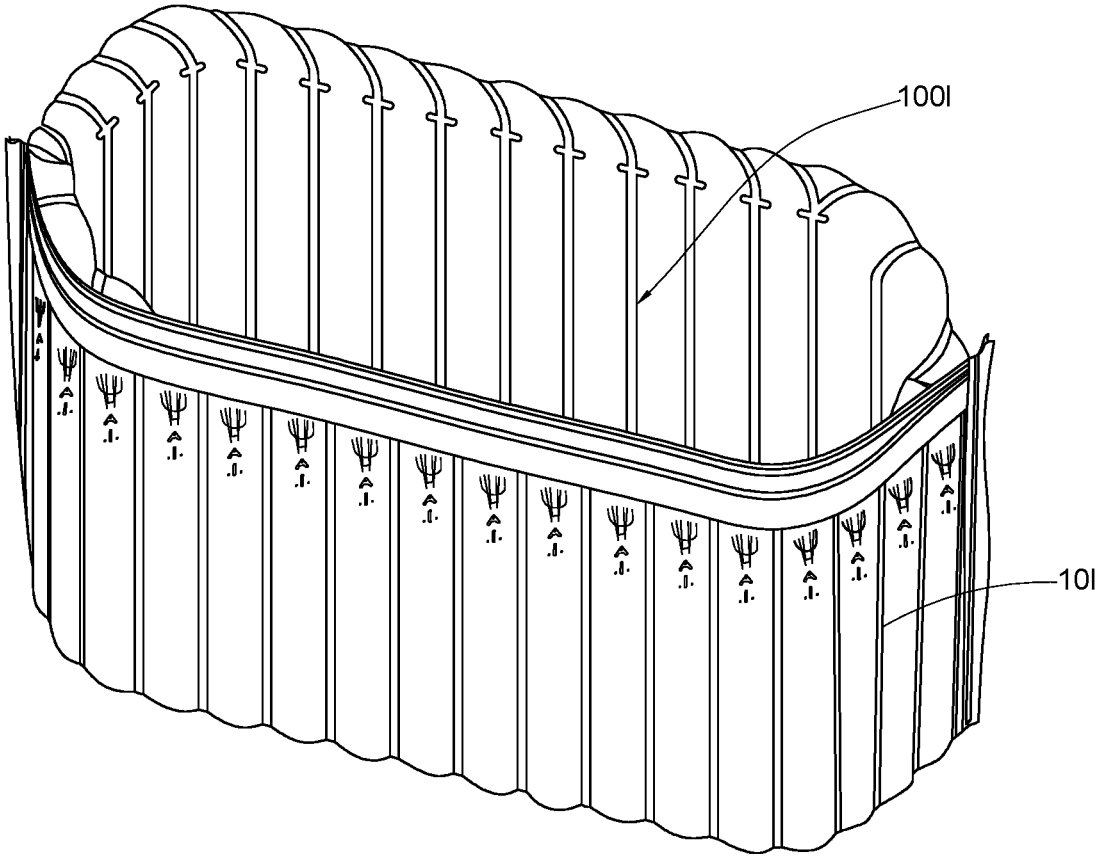

As shown in FIG. 27, after being inflated, the inflatable main body 10*j* can form a plurality of containing cavity 100*j* being suitable to contain a plurality of packaged items. As shown in FIG. 28, the inflatable main body 10*k* can have a multi-layer structure, for example a double-layer inflating overlapping structure can be formed by an inner layer inflatable main body and an outer layer inflatable main body. As can be shown in FIG. 29, the stagger and overlapping structure can also be formed between the inflatable cells 111 of the inner layer of inflatable main body 101 and the inflatable cells 111 of the outer layer of inflatable main body, so as to reduce the thickness thereof and to enhance the air cushion affect.

It is worth mentioning that FIGS. 1-29 illustrate various alternative modes of the inflatable main bodies 10. In practical application, other alternative modes are proper as long as an air cushion affect can be provided in the packaging box.

In addition, the inflating valve 20 can be formed by two or more layers of thin films. Inflating valves with other structure is proper, such as a mechanical valve which is provided to the inflatable main body 10, or be further fixed to the box body 30.

Figure 30:
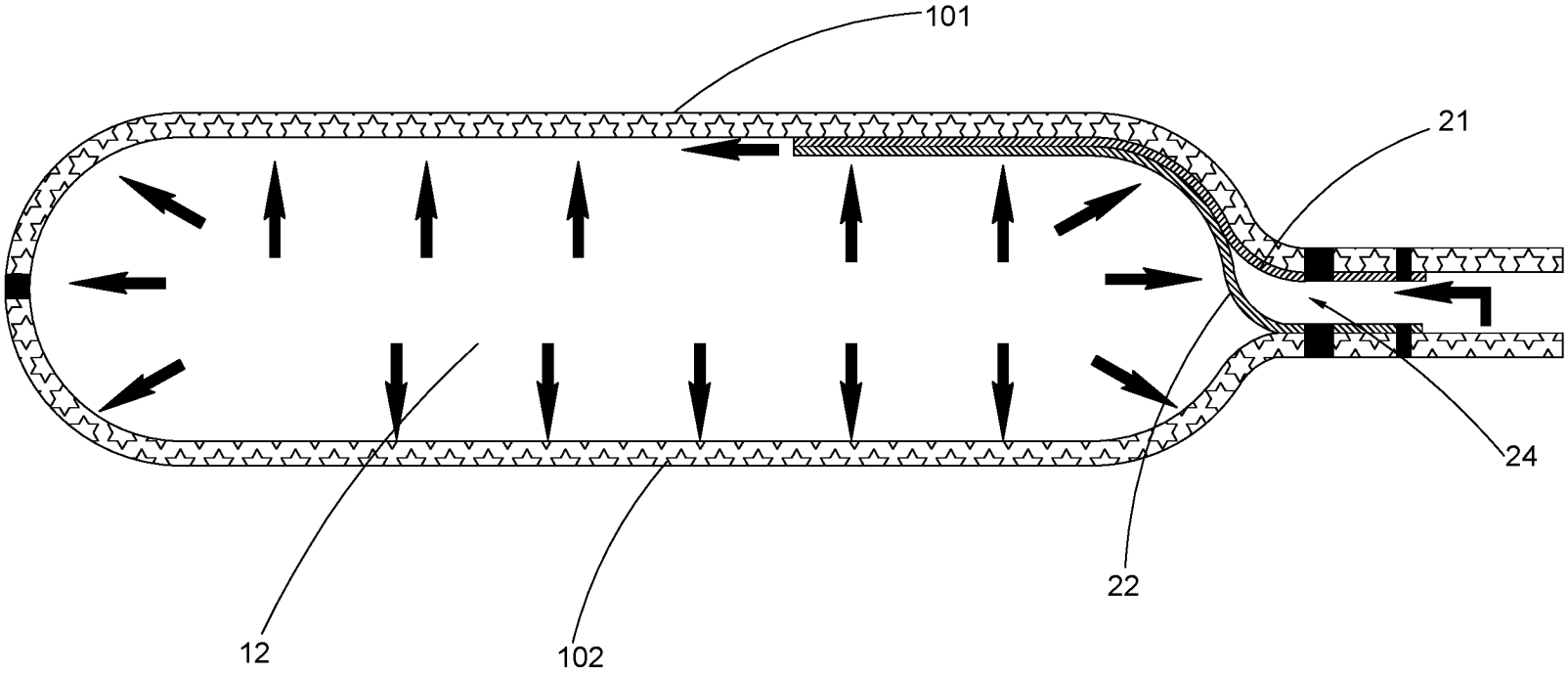
FIG. 30 is a schematic view of an inflating valve of the air cushion packaging box according to the above second preferred embodiment of the present invention.
Figure 31:
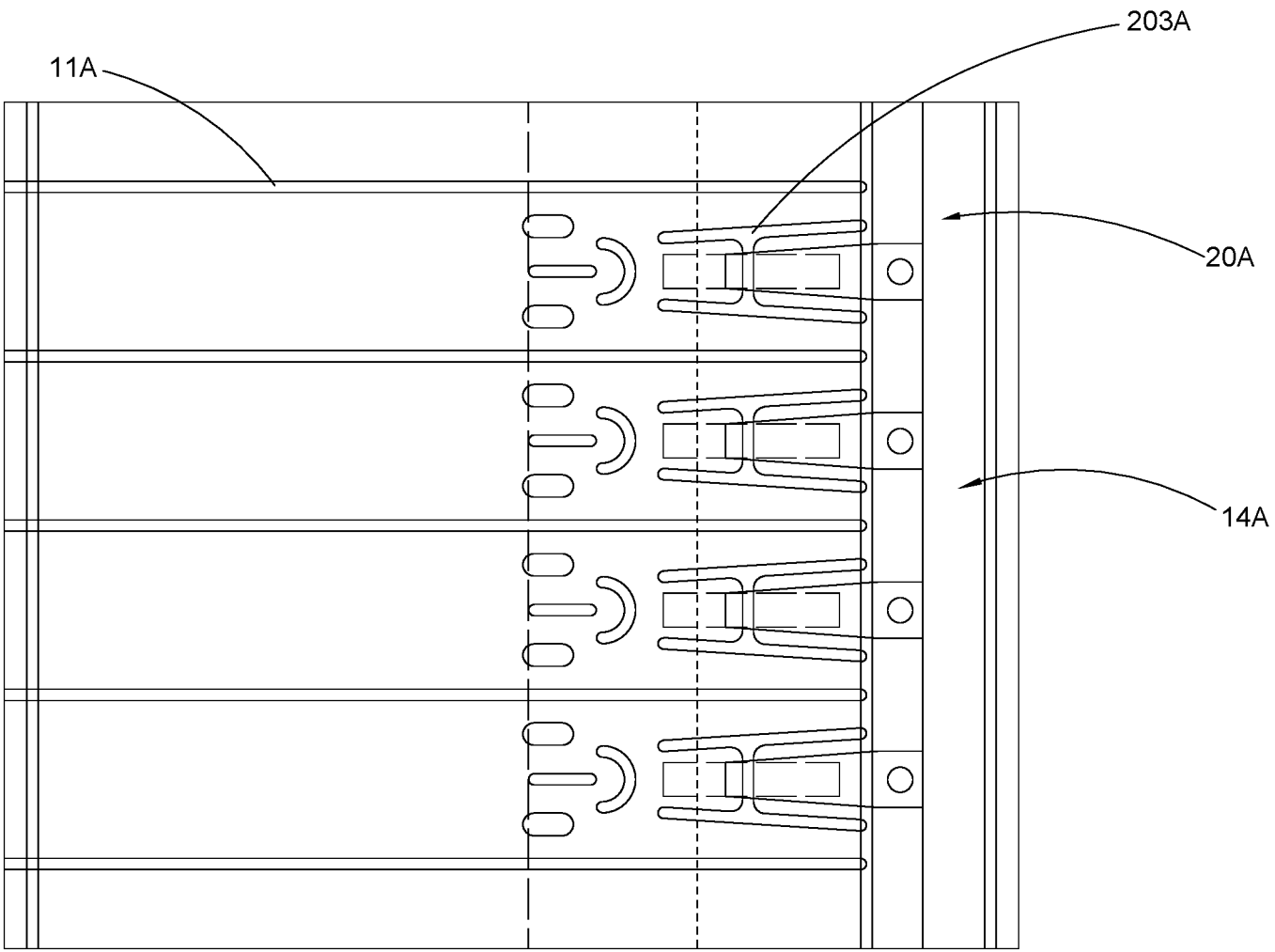
FIG. 31 is a schematic view of another inflating valve of the air cushion packaging box according to the above second preferred embodiment of the present invention.
Figure 32:
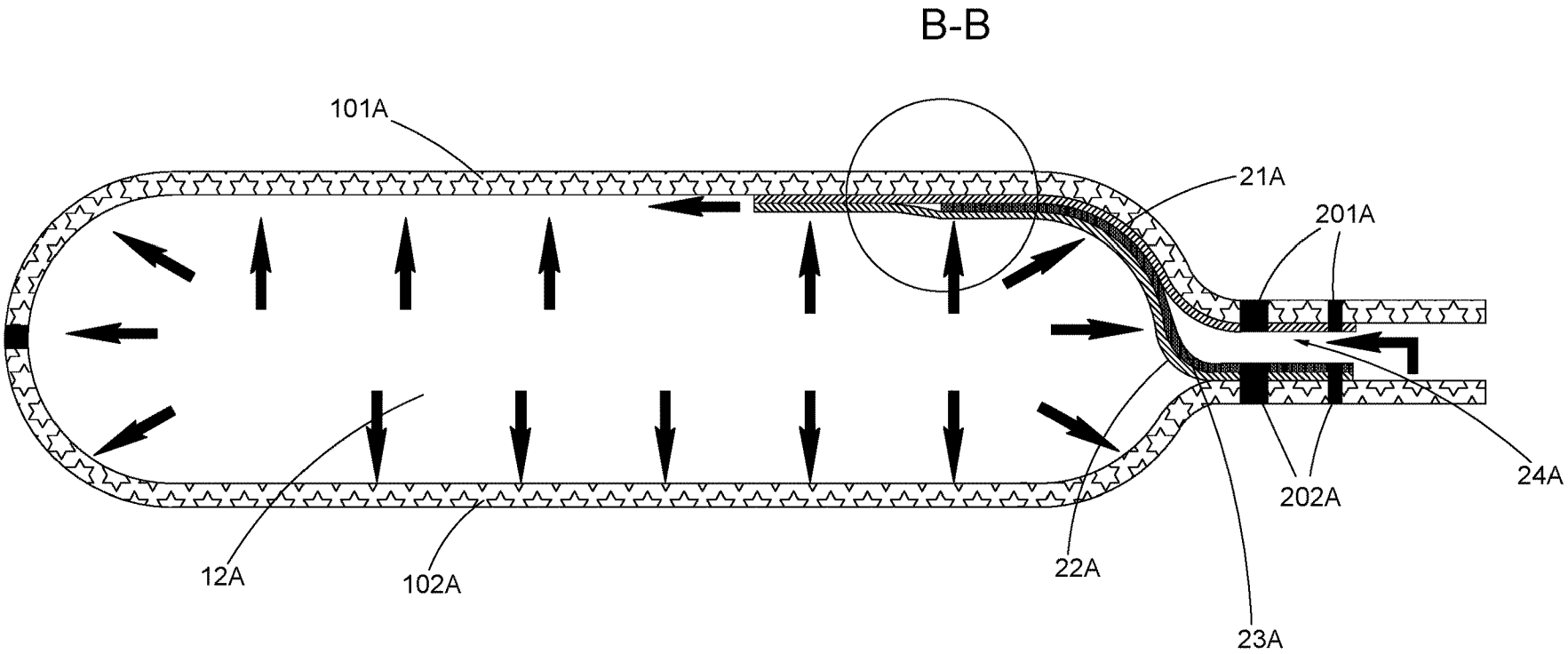
FIG. 32 is a sectional view of the above another inflating valve of the air cushion packaging box according to the above second preferred embodiment of the present invention.

As shown in FIG. 30, the inflating valve 20 is a non-return valve comprising two sealing films 21 and 22. The first and second sealing films 21, 22 are overlapped between the first and second cell layers 101 and 102, so as to form a four-layer structure. An air inflating channel 24 is formed between the two sealing films 21 and 22. Correspondingly, after the inflatable main body 10 is inflated with air, the two sealing films 21, 22 are bonded together, so as to seal the air bag the air inflating channel, so that air is sealed into the inflatable cavity 12 of the air bag 10. If the inflatable main body 10 comprises more than one inflatable cell 11, more than one inflating valve 20 is correspondingly provided to each of the inflatable cells 11, so as to seal air into each corresponding inflatable cell 11. Specially, the first sealing film 21 is overlapped and bonded to the first chamber layer 101. The second sealing film 22 is overlapped and bonded to the second chamber layer 102. When the inflatable main body 10 is being inflated, air is guided into the air inflating channel 24 formed between the first sealing film 21 and the second sealing film 22. When the inflatable main body is full of air, the first sealing film 21 and the second sealing film 22 are adhered with each other, so as to seal the air inflating channel 24 of the inflatable main body. In addition, the air pressure in the inflatable main body apply to the two sealing films 21 and 22, so as to ensure the two sealing films 21 and 22 adhering with each other tightly, so as to avoid air from leaking through the inflating valve 20. In other words, the inflating valve 20 is a non-return valve, which allows air to enter into the inflatable main body 10 and avoid air from leaking out of the inflatable main body 10.

The forming of the air inflating channel 24 of the inflating valve 20 is realized by providing a blocking device between the two sealing films 21 and 22. When the two sealing films 21 and 22 and the two cell layers 101 and 102 are being sealing, due to the blocking device is provided, the two sealing films 21 and 22 are not entirely sealed together, so as to form the air inflating channel 24. According to one embodiment of the present invention, the blocking device can be high temperature durable ink.

FIGS. 31-33B illustrate an air packaging device according to another embodiment of the present invention, which mainly illustrates the structure of another inflating valve 20A. The inflating valve 20A is a double non-return valve, so as to provide double sealing effect to the inflatable main body. The inflating valve 20A comprises a first sealing film 21A, a second sealing film 22A and a non-return sealing film 23A.

The first sealing film 21A and the second sealing film 22A are overlapped between the first chamber layer 101A and the second chamber layer 102A of the inflatable cell 11A. The first sealing film 21A and the second sealing film 22A are two thin flexible films overlapping with each other, which are made of plastic. Preferably, the first sealing film 21A and the second sealing film 22A are two same films.

Each of the first sealing films 21A and the second sealing films 22A has a first edge, i.e. a near edge extended to the exit of the inflating valve 20A of the inflatable cell 11A, and a second edge, i.e. A far edge extended into the inflatable cell. Preferably, the first edges and the second edges of the first sealing films 21A and the second sealing films 22A are respectively adjacent to each other.

According to this preferred embodiment, the first edges of the first sealing films 21A are attached to the first chamber layer 101A. The first edges of the second sealing films 22A are attached to the second chamber layer 102A.

The non-return sealing film 23A overlaps with the first edges of the first sealing films 21A and the second sealing films 22A, so as to form an air inflating channel 24A between the first sealing film 21A and the non-return sealing film 23A, and to form a non-return channel 25A between the non-return sealing film 23A and the second sealing film 22A.

Figure 33A:
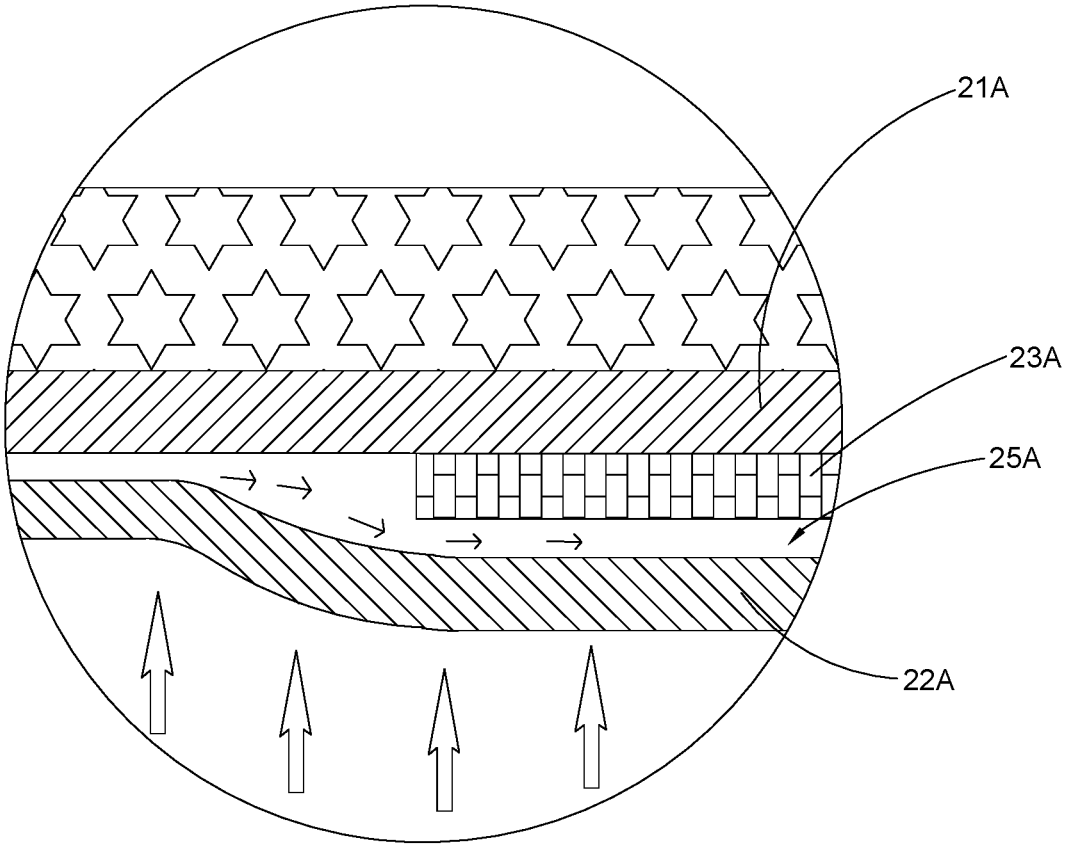
FIGS. 33A-33B are partial enlarged views of the above another inflating valve of the air cushion packaging box according to the above second preferred embodiment of the present invention.
Figure 33B:
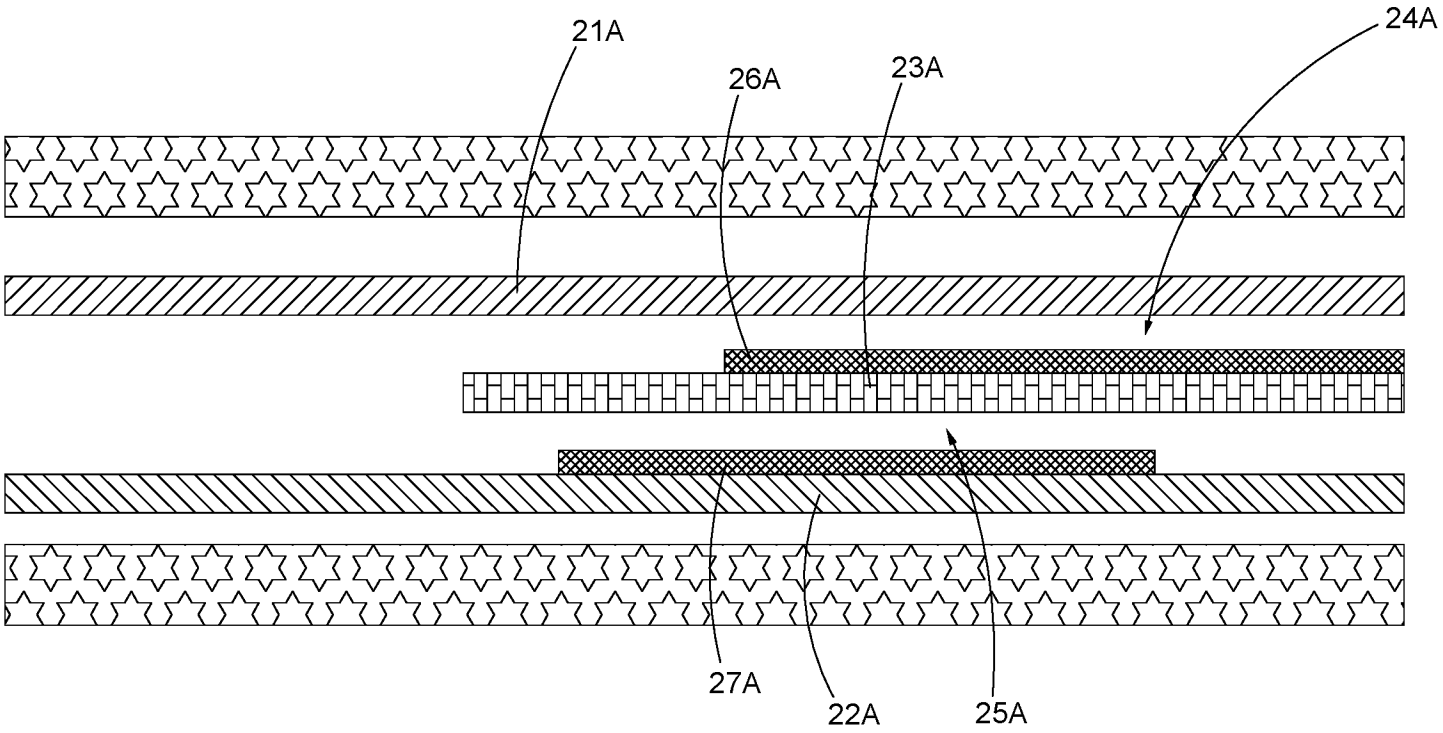

The air inflating channel 24A is arranged to be used to inflate air into the inflatable cavity 12A so as to fill the inflatable cell 11A until the air in the inflatable cavity 12A can make the seconds edges of the first sealing film 21A and the second sealing film 22A to be overlapped to seal and to close the air inflating channel 24A. According to this preferred embodiment of the present invention, if air is leaked through space between the second edges of the first sealing film 21A and the second sealing film 22A, as shown in FIGS. 33A and 33B, the air in the inflatable cavity 12 is guided into the non-return channel 25A, so as to provide an air supplement and further seal the air inflating channel 24A, so as to enhance the sealing effect of the first sealing film 21A and the second sealing film 22A.

The air inflating channel 24A has two open ends, i.e. a first open end and a second open end. The first open end, i.e. A near open end is formed between the first edges of the first sealing film 21A and the first end of the corresponding non-return sealing film 23A. The second open end i.e. A second open end is extended to the second edge of the first sealing film 21A and the second edge of the corresponding second sealing film 22A, so as to communicate with the inflatable cavity 12A. Compressed air can be guided into the inflatable cavity 12A through the air inflating channel 24A.

It is worth mentioning that when the inflatable cell 11A is full of air, the pressure in the inflatable cavity 12A is press to the first sealing film 21A and the second sealing film 22A, so as to sealing the gap between the first sealing film 21A and the second sealing film 22A and seal the second open end of the air inflating channel 24A. In addition, the second edge of the first sealing film 21A and the second edge of the second sealing film 22A are sealed together due to surface tension.

The non-return sealing film 23A is thin flexible film made of plastic. Preferably, the non-return sealing film 23A, the first sealing film 21A and the second sealing film 22A are poly ethylene films. In addition, the thickness of each first chamber layer 101A and each second chamber layer 102A is greater than the thickness of the first sealing film 21A, the second sealing film 22A and the non-return sealing film 23A.

According to the preferred embodiment of the present invention, the length of the non-return sealing film 23A is smaller than the length of the first sealing film 21A and the second sealing film 22A, so that when the non-return sealing film 23A overlaps to the first edge of the first sealing film 21A and the second sealing film 22A, the second edge of the first sealing film 21A and the second edge of the second sealing film 22A are overlapped together. It is worth mentioning that the length of the non-return sealing film 23A is defined as the distance between the first edge of the non-return sealing film 23A and the second edge of the non-return sealing film 23A. The length of each first sealing film 21A is defined as the distance between the first edge of the first sealing film 21A and the second edge of the first sealing film 21A. The length of the second sealing film 22A is defined as the distance between the first edge of the second sealing film 22A and the second edge of the second sealing film 22A.

Correspondingly, the first edge of the first sealing film 21A and the first edge of the second sealing film 22A and the first edge of the non-return sealing film 23A are adjacent to each other. In addition, the first edge of the non-return sealing film 23A is bonded to the first edge of the second sealing film 22A.

The non-return channel 25A is form between the non-return sealing film 23A and the second sealing film 22A, wherein the non-return channel 25A has an open end facing the inflatable cavity 12A and a closed end facing the opening of the air valve. In other words, the first edge of the non-return channel 25A is the closed end and the second edge of the non-return channel 25A is the open end.

Correspondingly, while air in inflated into the non-return channel 25A through the open end, the non-return channel 25A is filled with air to product a pressure supplement, so as to further seal the air inflating channel 24A between the first sealing film 21A and the second sealing film 22A.

It is worth mentioning that while inflating air into the inflatable cavity 12A through the air inflating channel 24A, the flow direction of the air in the air inflating channel 24A is opposite to the flow direction of the air in the non-return channel 25A. Thus, air will not be filled into the non-return channel 25A. While air is leaked back from the inflatable cavity 12A to the non-return channel 25A, air enters into the non-return channel 25A, so as to generate a pressure supplement and further seal the air inflating channel 24A, so as to avoid leaking air. It is worth mentioning that before being leaked through the first open end of the air inflating channel 24A, the leaked air flows from the second end of the air inflating channel 24A to the second open end of the non-return channel 25A, so as to avoid the air being leaked. In addition, the non-return sealing film 23A and the first sealing film 21A are sealed together due to the surface tension, so as to seal the air inflating channel 24A.

In order to form the inflating valve 20A to the inflatable cell 11A, the inflating valve 20A further comprises a first seal joint portion 201 and a second seal joint portion 202. The first seal joint portion is provided to bond the first chamber layer 101A and the first sealing film 21A together at the opening of the air valve of the inflatable cell 11A. The second seal joint portion is used to bond the second chamber layer 102A, the non-return sealing film 23A and the second sealing film 22A together at the opening of the air valve of the inflatable cell 11A.

Correspondingly, the first edge of the first sealing film 21A is bonded to the first chamber layer 101A via the first seal joint portion 201. The second chamber layer 102A, the first edge of the second sealing film 22A and the first edge of the non-return sealing film 23A are bonded together via the second seal joint portion 202A. Preferably, two interval seal joint portions 201A are used to bond the first chamber layer 101A and the first sealing film 21A. Two interval second seal joint portions 202A are used to bond the second chamber layer 102A, the non-return sealing film 23A and the second sealing film 22A. It is worth mentioning that the first seal joint portion 201A and the second seal joint portion 202A not only can be heat sealing line, but also can be heat sealing which other shapes. In other words, the first edge of the first sealing film 21A and the first chamber layer 101A are sealed together via the seal joint portion 201A. The second chamber layer 102A and the first edge of the second sealing film 22A and the first edge of the non-return sealing film 22 are sealed together via the second seal joint portion 202A.

In order to keep a apace between the first sealing film 21A and the non-return sealing film 23A after being sealed, the inflating valve 20A further comprises a first heat resisting item 26A, which is formed between the first sealing film 21A and the non-return sealing film 23A, so as to ensure the air inflating channel 24A being formed. The first heat resisting item 26A is provided to avoid the first sealing film 21A and the non-return sealing film 23A being entirely bonded together during the process of heat sealing.

In detail, the first heat resisting item 26A is provided to the first edge of the first sealing film 21A, the first edge of the non-return sealing film 23A and the opening of the air valve of the inflatable cell 11A, so as to ensure the first end of the air inflating channel 24A being in an opening state.

In similar, in order to keep the space between the second sealing film 22A and the non-return sealing film 23A after the process of heat sealing, the inflating valve 20A further comprises a second heat resisting item 27A formed between the second sealing film 22A and the non-return sealing film 23A to ensure forming of the non-return channel 25A.

In detail, the second heat resisting item 27A is provided to the second edge of the second sealing film 22A and the second edge of the non-return sealing film 23A, so as to ensure the second end of the non-return channel 25A being in an opening state. It is worth mentioning that the first end of the non-return channel 25A is closed by the second seal joint portion 202.

According to the preferred embodiment of the present invention, the first heat resisting item 26A and the second heat resisting item 27A are two heat-resisting layers, which are coated to predetermined position of corresponding films, so as to avoid the films being attached together at the process of heat sealing. The first heat resisting item 26A is extended to the first end of the non-return sealing film 23A and faces to the first sealing film 21A. The second heat resisting item 27A is extended to an opposite side of the second end of the non-return sealing film 23A and faces to the second sealing film 22A, wherein the second heat resisting item 27A is not provided to the opposite side of the first end of the non-return sealing film 23A, thus, the first end of the non-return channel 25A can be closed by the second seal joint portion 202A. It is worth mentioning that the second heat resisting item 27A not only avoid the non-return sealing film 23A and the second sealing film 22A being attached together to ensure the second end of the non-return channel 25A being in an opening state, but also enhance the force between the non-return sealing film 23A and the first sealing film 21A, so as to close the air inflating channel 24A via surface tension.

The inflating valve 20A further comprises two side seal joint portions 203A, i.e. two third seal joint portions being used to attach the first sealing film 21A and the non-return sealing film 23A, so as to form side walls of the air inflating channel 24A. The width of the air inflating channel 24A is defined by the two side seal joint portions 203A. In detail, the two side seal joint portions 203A 为 two slant heat-sealing lines, so that the width of the air inflating channel 24A decreases progressively from the inflatable cavity at the opening of the air valve. In other words, a first opening end, i.e. A near opening end of the air inflating channel 24A is a bigger opening end communicating with the opening of the air valve. A second opening end, i.e. a far opening end of the air inflating channel 24A is a taper opening end communicating with the inflatable cavity 12A. The taper air inflating channel 24A further avoids air from being leaked to the opening of the air valve from the inflatable cavity 12A.

Preferably, the side seal joint portions 203A are extended from the first edge of the first sealing film 21A and the first edge of the second sealing film 22A to the second edge of the first sealing film 21A and the second edge of the second sealing film 22A. Thus, the side seal joint portions 203A are provided to the first end of the first sealing film 21A and the first end of the second sealing film 22A, and are attached together with the non-return sealing film 23A. The side seal joint portions 203A are provided to the second end of the first sealing film 21A and the second end of the second sealing film 22A and are attached together with the first sealing film 21A and the second sealing film 22A.

Correspondingly, in order to inflate into the inflatable cell 11A, a pump is inserted to the air inflating opening 13A to fill compressed air into the air inflating channel 24A, wherein the air inflating direction is from the first opening end of the air inflating channel 24A to the second opening end of the air inflating channel 24A. Thus, the inflatable cell 11A starts to be inflated. The pressure of inflatable cavity 12A is enlarged to push the first chamber layer 101A and the second chamber layer 102A. At the same time, the pressure acts on the first sealing film 21A and the second sealing film 22A, and particularly on the second end of the first sealing film 21A and the second end of the second sealing film 22A. After the inflatable cell 11A is fully filled with air, i.e. The maximum loading lever is reached, the pressure in the inflatable cavity 12A is big enough to seal the second end of the first sealing film 21A and the second end of the second sealing film 22A, so as to seal the second opening end of the air inflating channel 24A automatically. Then the pump is put out of the air inflating opening 13A.

While the second end of the first sealing film 21A and the second end of the second sealing film 22A are not entirely sealed together, it is likely that the air in the inflatable cavity 12A being leaked to the air inflating channel 24A. To avoid air from being leaked to the air inflating channel 24A, the non-return sealing film 23A is sealed to the first sealing film 21A to seal the second opening end of the air inflating channel 24A. In detail, the air inflow direction of the non-return channel 25A is opposite to the air inflating direction of the air inflating channel 24A. In addition, while the opening end of the non-return channel 25A being open, the second opening end of the air inflating channel 24A is closed. Thus, air enters from the opening end of the non-return channel 25A and is retained in the non-return channel 25A.

The non-return channel 25A is filled with air, so a pressure supplement is produced in the non-return channel 25A to further seal the air inflating channel 24A. Specially, the second opening end of the air inflating channel 24A between the first sealing film 21A and the non-return sealing film 23A is sealed. More specifically, the higher the pressure supplement in the non-return channel 25A is, the better the sealing effect of the non-return sealing film 23A is. In other words, while air is leaked from the inflatable cavity 12A to reduce the pressure of the inflatable cavity 12A, air enters into the non-return channel 25A to enhance the pressure of the non-return channel 25A. Thus, the total pressure of inflating, i.e. The sum of the pressure of the inflatable cavity 12A and the pressure of the non-return channel 25A remains unchanged. Thus, air enters into the non-return channel 25A from the inflatable cavity 12A enhance the sealing effect of the air inflating channel 24A.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method of packaging a packaged item in a packaging box, comprising the steps of:

(a) forming an inflatable main body is formed at an inner surface of a box body that said box body receives the packaged item therein; and (b) inflating said inflatable main body to surround the packaged item within said inflatable main body for providing an air cushion effect to the packaged item in said box body, wherein said box body is foldable that said box body is folded flat when said inflatable main body is deflated and said box body is unfolded by an inflation of said inflatable main body to provide a containing space within said box body for surrounding the packaged item by said inflatable main body within said containing space.

2. A method of packaging a packaged item in a packaging box, comprising the steps of:

(a) forming an inflatable main body is formed at an inner surface of a box body that said box body receives the packaged item therein; and (b) inflating said inflatable main body to surround the packaged item within said inflatable main body for providing an air cushion effect to the packaged item in said box body, wherein said inflatable main body is inflated via a inflating valve provided thereat, wherein said inflatable main body has a first chamber layer and a second chamber layer, wherein said inflating valve is a single direction non-return valve being provided between said first chamber layer and said second chamber layer, wherein when said inflatable main body is fully inflated, said single direction non-return valve is closed itself to avoid air from being leaked, wherein said inflating valve, which is a double non-return valve, comprises:

a first sealing film and a second sealing film, wherein said first sealing film and said second sealing film are overlapped between said first chamber layer and said second chamber layer of said inflating cell, wherein said first sealing film and said second sealing film are extended into said inflatable cavity through an opening of said inflating cell; and a non-return sealing film being overlapped to a first end of said first sealing film and a first end of said second sealing film, so as to form an air inflating channel between said first sealing film and said non-return sealing film, and form a non-return channel between said non-return sealing film and said second sealing film, wherein said air inflating channel is arranged for inflating the air into said inflatable cavity, so as to fill said inflatable cell until a pressure in said inflatable cavity makes a second end of said first sealing film and a second end of said second sealing film overlapping and sealing to close said air inflating channel, wherein if the air is leaked between said second end of said first sealing film and said second end of said second sealing film, air in said inflatable cavity is guided into said non-return channel, so as to provide a pressure supplement, and further seal said air inflating channel, so as to enhance the sealing effect of said first sealing film and said second sealing film.

* * * * *